US010760151B2

(12) United States Patent
Doud et al.

(10) Patent No.: US 10,760,151 B2
(45) **Date of Patent: *Sep. 1, 2020**

(54) GALVANICALLY-ACTIVE IN SITU FORMED PARTICLES FOR CONTROLLED RATE DISSOLVING TOOLS

(71) Applicant: Terves Inc., Euclid, OH (US)

(72) Inventors: Brian P. Doud, Cleveland Heights, OH (US); Nicholas J. Farkas, Euclid, OH (US); Andrew J. Sherman, Mentor, OH (US)

(73) Assignee: Terves, LLC, Euclid, OH (US)

( * ) Notice: Subject to any disclaimer, the term of this patent is extended or adjusted under 35 U.S.C. 154(b) by 153 days.

This patent is subject to a terminal disclaimer.

(21) Appl. No.: 15/888,751

(22) Filed: Feb. 5, 2018

(65) Prior Publication Data

US 2018/0155813 A1 Jun. 7, 2018

Related U.S. Application Data

(62) Division of application No. 14/689,295, filed on Apr. 17, 2015, now Pat. No. 9,903,010.

(Continued)

(51) Int. Cl.
*C22F 1/06* (2006.01)
*C22C 1/02* (2006.01)

(Continued)

(52) U.S. Cl.
CPC ..... *C22F 1/06* (2013.01); *C22C 1/02* (2013.01); *C22C 23/02* (2013.01); *C22C 23/00* (2013.01)

(58) Field of Classification Search
CPC ... C22F 1/06; C22C 23/02; C22C 1/02; C22C 23/00

See application file for complete search history.

(56) References Cited

U.S. PATENT DOCUMENTS 3,180,728 A 4/1965 Pryor et al.
3,445,731 A 5/1969 Saeki et al.

(Continued)

FOREIGN PATENT DOCUMENTS

CA 2886988 10/2015
CN 101381829 3/2009

(Continued)

OTHER PUBLICATIONS

Sigworth et al. "Grain Refinement of Aluminum Castings Alloys" American Foundry Society; Paper 07-67; pp. 5-7 (2007).

(Continued)

*Primary Examiner* — Anthony J Zimmer
(74) *Attorney, Agent, or Firm* — Fay Sharpe LLP

(57) ABSTRACT

A castable, moldable, and/or extrudable structure using a metallic primary alloy. One or more additives are added to the metallic primary alloy so that in situ galvanically-active reinforcement particles are formed in the melt or on cooling from the melt. The composite contain an optimal composition and morphology to achieve a specific galvanic corrosion rate in the entire composite. The in situ formed galvanically-active particles can be used to enhance mechanical properties of the composite, such as ductility and/or tensile strength. The final casting can also be enhanced by heat treatment, as well as deformation processing such as extrusion, forging, or rolling, to further improve the strength of the final composite over the as-cast material.

100 Claims, 4 Drawing Sheets

Related U.S. Application Data

(60) Provisional application No. 61/981,425, filed on Apr. 18, 2014.

(51) Int. Cl.
*C22C 23/02* (2006.01)
*C22C 23/00* (2006.01)

(56) References Cited

U.S. PATENT DOCUMENTS 4,264,362 A 4/1981 Serveg et al.
4,655,852 A 4/1987 Rallis
4,875,948 A 10/1989 Verneker
5,106,702 A 4/1992 Walker et al.
5,240,495 A 8/1993 Dieckmann et al.
5,336,466 A 8/1994 Iba
5,342,576 A 8/1994 Whitehead
5,552,110 A 9/1996 Iba
5,767,562 A 6/1998 Yamashita
5,894,007 A 11/1999 Yuan et al.
5,980,602 A 11/1999 Carden
6,036,792 A 3/2000 Chu et al.
6,126,898 A 10/2000 Butler
6,422,314 B1 7/2002 Todd et al.
6,444,316 B1 9/2002 Reddy et al.
6,527,051 B1 3/2003 Reddy et al.
6,554,071 B1 4/2003 Reddy et al.
6,737,385 B2 5/2004 Todd et al.
7,350,582 B2 4/2008 McKeachnie et al.
7,353,879 B2 4/2008 Todd et al.
7,531,020 B2 5/2009 Woodfield et al.
7,647,964 B2 1/2010 Akbar et al.
7,690,436 B2 4/2010 Turley et al.
7,771,547 B2 8/2010 Bieler et al.
7,794,520 B2 9/2010 Murty et al.
7,879,162 B2 2/2011 Pandey
7,999,987 B2 8/2011 Dellinger et al.
8,034,152 B2 10/2011 Westin et al.
8,211,247 B2 7/2012 Marya et al.
8,211,248 B2 7/2012 Marya
8,211,331 B2 7/2012 Jorgensen et al.
8,220,554 B2 7/2012 Jordan et al.
8,230,731 B2 7/2012 Dyer et al.
8,267,177 B1 9/2012 Vogel et al.
8,327,931 B2 12/2012 Agrawal et al.
8,403,037 B2 3/2013 Agrawal et al.
8,413,727 B2 4/2013 Holmes
8,425,651 B2 4/2013 Xu et al.
RE44,385 E 7/2013 Johnson
8,485,265 B2 7/2013 Marya et al.
8,486,329 B2 7/2013 Shikai et al.
8,506,733 B2 8/2013 Enami et al.
8,528,633 B2 9/2013 Agrawal et al.
8,573,295 B2 11/2013 Johnson et al.
8,613,789 B2 12/2013 Han et al.
8,631,876 B2 1/2014 Xu et al.
8,663,401 B2 3/2014 Marya et al.
8,668,762 B2 3/2014 Kim et al.
8,695,684 B2 4/2014 Chen et al.
8,695,714 B2 4/2014 Xu
8,714,268 B2 5/2014 Agrawal et al.
8,723,564 B2 5/2014 Kim et al.
8,746,342 B1 6/2014 Nish et al.
8,776,884 B2 7/2014 Xu
8,789,610 B2 7/2014 Oxford
8,808,423 B2 8/2014 Kim et al.
8,905,147 B2 12/2014 Fripp et al.
8,967,275 B2 3/2015 Crews
9,016,363 B2 4/2015 Xu et al.
9,016,384 B2 4/2015 Xu
9,027,655 B2 5/2015 Xu
9,068,428 B2 6/2015 Mazyar et al.
9,080,439 B2 7/2015 O'Malley
9,101,978 B2 8/2015 Xu
9,181,088 B2 11/2015 Sibuet et al.
9,187,686 B2 11/2015 Crews
9,217,319 B2 12/2015 Frazier et al.
9,227,243 B2 1/2016 Xu et al.
9,243,475 B2 1/2016 Xu
9,309,744 B2 4/2016 Frazier
9,447,482 B2 9/2016 Kim et al.
9,528,343 B2 12/2016 Jordan et al.
9,605,508 B2 3/2017 Xu
9,938,451 B2 4/2018 Crews
2002/0102179 A1 8/2002 Murai
2002/0121081 A1 9/2002 Cesaroni et al.
2002/0197181 A1 12/2002 Osawa et al.
2003/0173005 A1 9/2003 Higashi
2005/0194141 A1 9/2005 Sinclair et al.
2006/0113077 A1 6/2006 Willberg et al.
2006/0131031 A1 6/2006 McKeachnie
2006/0175059 A1 8/2006 Sinclair et al.
2006/0207387 A1 9/2006 Soran et al.
2006/0278405 A1 12/2006 Turley
2007/0181224 A1 8/2007 Marya et al.
2008/0041500 A1 2/2008 Bronfin
2008/0149345 A1 6/2008 Marya et al.
2008/0175744 A1 7/2008 Motegi
2009/0116992 A1 5/2009 Lee
2009/0226340 A1 9/2009 Marya
2010/0119405 A1 5/2010 Okamoto et al.
2010/0161031 A1 6/2010 Papirov et al.
2010/0270031 A1 10/2010 Patel
2010/0304178 A1 12/2010 Dirscherl
2011/0048743 A1 3/2011 Stafford et al.
2011/0067889 A1 3/2011 Marya et al.
2011/0091660 A1 4/2011 Dirscherl
2011/0135530 A1 6/2011 Xu et al.
2011/0221137 A1 9/2011 Obi et al.
2011/0236249 A1 9/2011 Kim et al.
2012/0080189 A1 4/2012 Marya et al.
2012/0097384 A1 4/2012 Valencia et al.
2012/0103135 A1 5/2012 Xu et al.
2012/0125642 A1 5/2012 Chenault
2012/0156087 A1 6/2012 Kawabata
2012/0177905 A1 7/2012 Seals et al.
2012/0190593 A1 7/2012 Soane et al.
2012/0273229 A1 11/2012 Xu et al.
2012/0318513 A1 12/2012 Mazyar et al.
2013/0022816 A1 1/2013 Smith et al.
2013/0029886 A1 1/2013 Mazyar et al.
2013/0032357 A1 2/2013 Mazyar et al.
2013/0043041 A1 2/2013 McCoy et al.
2013/0047785 A1 2/2013 Xu
2013/0056215 A1 3/2013 Crews
2013/0068411 A1 3/2013 Forde et al.
2013/0112429 A1 5/2013 Crews
2013/0133897 A1 5/2013 Bailhly et al.
2013/0160992 A1 6/2013 Agrawal et al.
2013/0168257 A1 7/2013 Mazyar et al.
2013/0199800 A1 8/2013 Kellner et al.
2013/0209308 A1 8/2013 Mazyar et al.
2013/0220496 A1 8/2013 Inoue
2013/0261735 A1 10/2013 Pacetti et al.
2013/0048289 A1 12/2013 Mazyar
2014/0018489 A1 1/2014 Johnson
2014/0027128 A1 1/2014 Johnson
2014/0060834 A1 3/2014 Quintero
2014/0093417 A1 4/2014 Liu
2014/0124216 A1 5/2014 Fripp et al.
2014/0190705 A1 7/2014 Fripp
2014/0196889 A1 7/2014 Jordan et al.
2014/0202284 A1 7/2014 Kim
2014/0202708 A1 7/2014 Jacob et al.
2014/0219861 A1 8/2014 Han
2014/0224477 A1 8/2014 Wiese et al.
2014/0236284 A1 8/2014 Stinson
2014/0271333 A1 9/2014 Kim et al.
2014/0286810 A1 9/2014 Marya
2014/0305627 A1 10/2014 Manke
2015/0102179 A1 4/2015 McHenry et al.
2015/0240337 A1 8/2015 Sherman et al.
2015/0247376 A1 9/2015 Tolman

(56) References Cited

U.S. PATENT DOCUMENTS

| | | | | |
|---|---|---|---|---|
| 2015/0299838 | A1* | 10/2015 | Doud | C22F 1/06 420/409 |
| 2015/0354311 | A1 | 12/2015 | Okura et al. | |
| 2016/0024619 | A1 | 1/2016 | Wilks | |
| 2016/0201425 | A1 | 7/2016 | Walton | |
| 2016/0201427 | A1 | 7/2016 | Fripp | |
| 2016/0201435 | A1 | 7/2016 | Fripp et al. | |
| 2016/0230494 | A1 | 8/2016 | Fripp | |
| 2016/0251934 | A1 | 9/2016 | Walton et al. | |
| 2016/0265091 | A1 | 9/2016 | Walton et al. | |

FOREIGN PATENT DOCUMENTS

| | | |
|---|---|---|
| CN | 102517489 | 6/2012 |
| CN | 102796928 | 11/2012 |
| CN | 103343271 | 10/2013 |
| CN | 103602865 | 2/2014 |
| CN | 103898384 | 7/2014 |
| EP | 0470599 | 2/1998 |
| EP | 2088217 | 8/2009 |
| JP | 2008266734 | 11/2008 |
| JP | 2012197491 | 10/2012 |
| JP | 2013019030 | 1/2013 |
| JP | 2014043601 | 3/2014 |
| KR | 20130023707 | 3/2013 |
| WO | US1990002655 | 3/1990 |
| WO | 1992013978 | 8/1992 |
| WO | 9857347 | 12/1998 |
| WO | 1999027146 | 6/1999 |
| WO | 2009055354 | 4/2009 |
| WO | 2009093420 | 7/2009 |
| WO | 2012091984 | 7/2012 |
| WO | 2013019410 | 2/2013 |
| WO | 2013019421 | 2/2013 |
| WO | 2013109287 | 7/2013 |
| WO | 2013122712 | 8/2013 |
| WO | 2013154634 | 10/2013 |
| WO | 2014100141 | 6/2014 |
| WO | 2014113058 | 7/2014 |
| WO | 2015171126 | 11/2015 |
| WO | 2016032758 | 3/2016 |
| WO | 2016032761 | 3/2016 |
| WO | 2016036371 | 3/2016 |

OTHER PUBLICATIONS

Momentive, "Titanium Diborid Powder" condensed product brochure; retrieved from https:/www.momentive.com/WorkArea/DownloadAsset.aspx?id+27489.; p. 1 (2012).

Durbin, "Modeling Dissolution in Aluminum Alloys" Dissertation for Georgia Institute of Technology; retrieved from https://smartech;gatech/edu/bitstream/handle/1853/6873/durbin_tracie_L_200505_phd.pdf> (2005).

Pegeut et al.., "Influence of cold working on the pitting corrosion resistance of stainless steel" Corrosion Science, vol. 49, pp. 1933-1948 (2007).

Elemental Charts from chemicalelements.com; retrieved Jul. 27, 2017.

Song et al., "Corrosion Mechanisms of Magnesium Alloys" Advanced Engg Materials, vol. 1, No. 1 (1999).

Zhou et al., "Tensile Mechanical Properties and Strengthening Mechanism of Hybrid Carbon Nanotubes . . . " Journal of Nanomaterials, 2012; 2012:851862 (doi: 10.1155/2012/851862) Figs. 6 and 7.

Trojanova et al., "Mechanical and Acoustic Properties of Magnesium Alloys . . . " Light Metal Alloys Application, Chapter 8, Published Jun. 11, 2014 (doi: 10.5772/57454) p. 163, para. [0008], [0014-0015]; [0041-0043].

AZoNano "Silicon Carbide Nanoparticles—Properties, Applications" http://www.amazon.com/articles.aspx?ArticleD=3396) p. 2, Physical Properties, Thermal Properties (May 9, 2013).

AZoM "Magnesium AZ91D-F Alloy" http://www.amazon.com/articles.aspx?ArticleD=8670) p. 1, Chemical Composition; p. 2 Physical Properties (Jul. 31, 2013.

Elasser et al., "Silicon Carbide Benefits and Advantages . . . " Proceedings of the IEEE, 2002; 906(6):969-986 (doi: 10.1109/JPROC2002.1021562) p. 970, Table 1.

Lan et al., "Microstructure and Microhardness of SiC Nanoparticles . . . " Materials Science and Engineering A; 386:284-290 (2004).

Casati et al., "Metal Matrix Composites Reinforced by Nanoparticles", vol. 4:65-83 (2014).

Saravanan et al., "Fabrication and characterization of pure magnesium-30 vol. SiCP particle composite", Material Science and Eng., vol. 276, pp. 108-116 (2000).

Song et al., Texture evolution and mechanical properties of AZ31B magnesium alloy sheets processed by repeated unidirectional bending, Journal of Alloys and Compounds, vol. 489, pp. 475-481 (2010).

Blawert et al., "Magnesium secondary alloys: Alloy design for magnesium alloys with improved tolerance limits against impurities", Corrosion Science, vol. 52, No. 7, pp. 2452-2468 (Jul. 1, 2010).

Wang et al., "Effect of Ni on microstructures and mechanical properties of AZ1 02 magnesium alloys" Zhuzao Foundry, Shenyang Zhuzao Yanjiusuo, vol. 62, No. 1, pp. 315-318 (Jan. 1, 2013).

Kim et al., "Effect of aluminum on the corrosions characteristics of Mg—4Ni—xAl alloys", Corrosion, vol. 59, No. 3, pp. 228-237 (Jan. 1, 2003).

Unsworth et al., "A new magnesium alloy system", Light Metal Age, vol. 37, No. 7-8., pp. 29-32 (Jan. 1, 1979).

Geng et al., "Enhanced age-hardening response of Mg—Zn alloys via Co additions", Scripta Materialia, vol. 64, No. 6, pp. 506-509 (Mar. 1, 2011).

Zhu et al., "Microstructure and mechanical properties of Mg6ZnCuO.6Zr (wt.%) alloys", Journal of Alloys and Compounds, vol. 509, No. 8, pp. 3526-3531 (Dec. 22, 2010).

International Search Authority, International Search Report and Written Opinion for PCT/GB2015/052169 (dated Feb. 17, 2016).

Search and Examination Report for GB 1413327.6 (dated Jan. 21, 2015).

Magnesium Elektron Test Report (dated Mar. 8, 2005).

New England Fishery Management Counsel, "Fishery Management Plan for American Lobster Amendment 3" (Jul. 1989).

Emly, E.F., "Principles of Magnesium Technology" Pergamon Press, Oxford (1966).

Shaw, "Corrosion Resistance of Magnesium Alloys", ASM Handbook, vol. 13A, pp. 692-696 (2003).

Hanawalt et al., "Corrosion studies of magnesium and its alloys", Metals Technology, Technical Paper 1353 (1941).

The American Foundry Society, Magnesium alloys, casting source directory 8208, available at www.afsinc.org/files/magnes.pdf.

Rokhlin, "Magnesium alloys containing rare earth metals structure and properties", Advances in Metallic Alloys, vol. 3, Taylor & Francis (2003).

Ghali, "Corrosion Resistance of Aluminum and Magnesium Alloys" pp. 382-389, Wiley Publishing (2010).

Kim et al., "High Mechanical Strengths of Mg—Ni—Y and MG—Cu Amorphous Alloys with Significant Supercooled Liquid Region", Materials Transactions, vol. 31, No. 11, pp. 929-934 (1990).

Tekumalla et al., "Mehcanical Properties of Magnesium—Rare Earth Alloy Systems", Metals, vol. 5, pp. 1-39 (2014).

National Physical Laboratory, "Bimetallic Corrosion" Crown (C) p. 1-14 (2000).

Ye et al., "Review of recent studies in magnesium matrix composites", Journal of Material Science, vol. 39, pp. 6153-6171 (2004).

Hassan et al., "Development of a novel magnesium-copper based composite with improved mechanical properties", Materials Research Bulletin, vol. 37, pp. 377-389 (2002).

Ye et al., "Microstructure and tensile properties of Ti6A14V/AM60B magnesium matrix composite", Journal of Alloys and Composites, vol. 402, pp. 162-169 (2005).

Kumar et al., "Mechanical and Tribological Behavior of Particulate Reinforced Aluminum metal Matrix Composite", Journal of Minerals & Materials Characterization and Engineering, vol. 10, pp. 59-91 (2011).

(56) References Cited

OTHER PUBLICATIONS

Majumdar, "Micromechanics of Discontinuously Reinforced MMCs", Engineering Mechanics and Analysis of Metal-Matrix Composites, vol. 21, pp. 395-406.
Scharf et al., "Corrosion of AX 91 Secondary Magnesiunm Alloy", Advanced Engineering Materials, vol. 7, No. 12, pp. 1134-1142 (2005).
Hillis et al., "High Purity Magnesium AM60 Alloy: The Critical Contaminant Limits and the Salt Water Corrosion Performance", SAE Technical Paper Series (1986).
Pawar, S.G., "Influence of Microstructure on the Corrosion Behaviour of Magnesium Alloys", PhD Dissertation, University of Manchester (2011).
Czerwinski, "Magnesium Injection Molding"; Technology & Engineering; Springer Science + Media, LLC, pp. 107-108, (Dec. 2007).
Metals Handbook, Desk Edition, edited by J.R. Davis, published by ASM International, pp. 559-574 (1998).

* cited by examiner

Highlighted In Situ Formed Particles

GALVANICALLY-ACTIVE IN SITU FORMED PARTICLES FOR CONTROLLED RATE DISSOLVING TOOLS

The present invention is a divisional of U.S. patent application Ser. No. 14/689,295 filed Apr. 17, 2015, which in turn claims priority on U.S. Provisional Patent Application Ser. No. 61/981,425 filed Apr. 18, 2014, which is incorporated herein by reference.

FIELD OF THE INVENTION

The present invention is directed to a novel magnesium composite for use as a dissolvable component in oil drilling.

BACKGROUND OF THE INVENTION

The ability to control the dissolution of a down hole well component in a variety of solutions is very important to the utilization of non-drillable completion tools, such as sleeves, frac balls, hydraulic actuating tooling, and the like. Reactive materials for this application, which dissolve or corrode when exposed to acid, salt, and/or other wellbore conditions, have been proposed for some time. Generally, these components consist of materials that are engineered to dissolve or corrode. Dissolving polymers and some powder metallurgy metals have been disclosed, and are also used extensively in the pharmaceutical industry for controlled release of drugs. Also, some medical devices have been formed of metals or polymers that dissolve in the body.

While the prior art well drill components have enjoyed modest success in reducing well completion costs, their consistency and ability to specifically control dissolution rates in specific solutions, as well as other drawbacks such as limited strength and poor reliability, have impacted their ubiquitous adoption. Ideally, these components would be manufactured by a process that is low cost, scalable, and produces a controlled corrosion rate having similar or increased strength as compared to traditional engineering alloys such as aluminum, magnesium, and iron. Ideally, traditional heat treatments, deformation processing, and machining techniques could be used on the components without impacting the dissolution rate and reliability of such components.

SUMMARY OF THE INVENTION

The present invention is directed to a novel magnesium composite for use as a dissolvable component in oil drilling and will be described with particular reference to such application. As can be appreciated, the novel magnesium composite of the present invention can be used in other applications (e.g., non-oil wells, etc.). In one non-limiting embodiment, the present invention is directed to a ball or other tool component in a well drilling or completion operation such as, but not limited to, a component that is seated in a hydraulic operation that can be dissolved away after use so that no drilling or removal of the component is necessary. Tubes, valves, valve components, plugs, frac balls, and other shapes and components can "also be formed of the novel magnesium composite of the present invention. For purposes of this invention, primary dissolution is measured for valve components and plugs as the time the part removes itself from the seat of a valve or plug arrangement or can become free floating in the system. For example, when the part is a plug in a plug system, primary dissolution occurs when the plug has degraded or dissolved to a point that it can no long function as a plug and thereby allows fluid to flow about the plug. For purposes of this invention, secondary dissolution is measured in the time the part is fully dissolved into sub-mm particles. As can be appreciated, the novel magnesium composite of the present invention can be used in other well components that also desire the function of dissolving after a period of time. In one non-limiting aspect of the present invention, a galvanically-active phase is precipitated from the novel magnesium composite composition and is used to control the dissolution rate of the component; however, this is not required. The novel magnesium composite is generally castable and/or machinable, and can be used in place of existing metallic or plastic components in oil and gas drilling rigs including, but not limited to, water injection and hydraulic fracturing. The novel magnesium composite can be heat treated as well as extruded and/or forged.

In one non-limiting aspect of the present invention, the novel magnesium composite is used to form a castable, moldable, or extrudable component. Non-limiting magnesium composites in accordance with the present invention include at least 50 wt. % magnesium. One or more additives are added to a magnesium or magnesium alloy to form the novel magnesium composite of the present invention. The one or more additives can be selected and used in quantities so that galvanically-active intermetallic or insoluble precipitates form in the magnesium or magnesium alloy while the magnesium or magnesium alloy is in a molten state and/or during the cooling of the melt; however, this is not required. The one or more additives typically are added in a weight percent that is less than a weight percent of said magnesium or magnesium alloy. Typically, the magnesium or magnesium alloy constitutes about 50.1 wt % 99.9 wt % of the magnesium composite and all values and ranges therebetween. In one non-limiting aspect of the invention, the magnesium or magnesium alloy constitutes about 60 wt. %-95 wt. % of the magnesium composite, and typically the magnesium or magnesium alloy constitutes about 70 wt. %-90 wt. % of the magnesium composite. The one or more additives are typically added to the molten magnesium or magnesium alloy at a temperature that is less than the melting point of the one or more additives. The one or more additives generally have an average particle diameter size of at least about 0.1 microns, typically no more than about 500 microns (e.g., 0.1 microns, 0.1001 microns, 0.1002 microns . . . 499.9998 microns, 499.9999 microns, 500 microns) and including any value or range therebetween, more typically about 0.1 to 400 microns, and still more typically about 10 to 50 microns. During the process of mixing the one or more additives in the molten magnesium or magnesium alloy, the one or more additives are typically not caused to fully melt in the molten magnesium or magnesium alloy. As can be appreciated, the one or more additives can be added to the molten magnesium or magnesium alloy at a temperature that is greater than the melting point of the one or more additives. In such a method of forming the magnesium composite, the one or more additives form secondary metallic alloys with the magnesium and/or other metals in the magnesium alloy, said secondary metallic alloys having a melting point that is greater than the magnesium and/or other metals in the magnesium alloy. As the molten metal cools, these newly formed secondary metallic alloys begin to precipitate out of the molten metal and form the in situ phase to the matrix phase in the cooled and solid magnesium composite. After the mixing process is completed, the molten magnesium or magnesium alloy and the one or more additives that are mixed in the molten magnesium or magnesium alloy are cooled to form a solid component. Generally, the temperature of the molten magnesium or magnesium alloy is at least about 10° C. less than the melting point of the additive added to the molten magnesium or magnesium alloy during the addition and mixing process, typically at least about 100° C. less than the melting point of the additive added to the molten magnesium or magnesium alloy during the addition and mixing process, more typically about 100° C.-1000° C. (and any value or range therebetween) less than the melting point of the additive added to the molten magnesium or magnesium alloy during the addition and mixing process; however, this is not required. The never melted particles and/or the newly formed secondary metallic alloys are referred to as in situ particle formation in the molten magnesium composite. Such a process can be used to achieve a specific galvanic corrosion rate in the entire magnesium composite and/or along the grain boundaries of the magnesium composite.

The invention adopts a feature that is usually a negative in traditional casting practices wherein a particle is formed during the melt processing that corrodes the alloy when exposed to conductive fluids and is imbedded in eutectic phases, the grain boundaries, and/or even within grains with precipitation hardening. This feature results in the ability to control where the galvanically-active phases are located in the final casting, as well as the surface area ratio of the in situ phase to the matrix phase, which enables the use of lower cathode phase loadings as compared to a powder metallurgical or alloyed composite to achieve the same dissolution rates. The in situ formed galvanic additives can be used to enhance mechanical properties of the magnesium composite such as ductility, tensile strength, and/or shear strength. The final magnesium composite can also be enhanced by heat treatment as well as deformation processing (such as extrusion, forging, or rolling) to further improve the strength of the final composite over the as-cast material; however, this is not required. The deformation processing can be used to achieve strengthening of the magnesium composite by reducing the grain size of the magnesium composite. Further enhancements, such as traditional alloy heat treatments (such as solutionizing, aging and/or cold working) can be used to enable control of dissolution rates though precipitation of more or less galvanically-active phases within the alloy microstructure while improving mechanical properties; however, this is not required. Because galvanic corrosion is driven by both the electro potential between the anode and cathode phase, as well as the exposed surface area of the two phases, the rate of corrosion can also be controlled through adjustment of the in situ formed particles size, while not increasing or decreasing the volume or weight fraction of the addition, and/or by changing the volume/weight fraction without changing the particle size. Achievement of in situ particle size control can be achieved by mechanical agitation of the melt, ultrasonic processing of the melt, controlling cooling rates, and/or by performing heat treatments. In situ particle size can also or alternatively be modified by secondary processing such as rolling, forging, extrusion and/or other deformation techniques.

In another non-limiting aspect of the invention, a cast structure can be made into almost any shape. During formation, the active galvanically-active in situ phases can be uniformly dispersed throughout the component and the grain or the grain boundary composition can be modified to achieve the desired dissolution rate. The galvanic corrosion can be engineered to affect only the grain boundaries and/or can affect the grains as well (based on composition); however, this is not required. This feature can be used to enable fast dissolutions of high-strength lightweight alloy composites with significantly less active (cathode) in situ phases as compared to other processes.

In still another and/or alternative non-limiting aspect of the invention, ultrasonic processing can be used to control the size of the in situ formed galvanically-active phases; however, this is not required.

In yet another and/or alternative non-limiting aspect of the invention, the in situ formed particles can act as matrix strengtheners to further increase the tensile strength of the material compared to the base alloy without the additive; however, this is not required.

In still yet another and/or alternative non-limiting aspect of the invention, there is provided a method of controlling the dissolution properties of a metal selected from the class of magnesium and/or magnesium alloy comprising of the steps of a) melting the magnesium or magnesium alloy to a point above its solidus, b) introducing an additive material and/or phase to the magnesium or magnesium alloy in order to achieve in situ precipitation of galvanically-active intermetallic phases, and c) cooling the melt to a solid form. The additive material is generally added to the magnesium or magnesium alloy when the magnesium or magnesium alloy is in a molten state and at a temperature that is less than the melting point of the additive material. The galvanically-active intermetallic phases can be used to enhance the yield strength of the alloy; however, this is not required. The size of the in situ precipitated intermetallic phase can be controlled by a melt mixing technique and/or cooling rate; however, this is not required. The method can include the additional step of subjecting the magnesium composite to intermetallic precipitates to solutionizing of at least about 300° C. to improve tensile strength and/or improve ductility; however, this is not required. The solutionizing temperature is less than the melting point of the magnesium composite. Generally, the solutionizing temperature is less than 50° C.-200° C. (the melting point of the magnesium composite) and the time period of solutionizing is at least 0.1 hours. In one non-limiting aspect of the invention, the magnesium composite can be subjected to a solutionizing temperature for about 0.5-50 hours (e.g., 1-15 hours, etc.) at a temperature of 300° C.-620° C. (e.g., 300° C.-500° C., etc.). The method can include the additional step of subjecting the magnesium composite to intermetallic precipitates and to artificially age the magnesium composite at a temperature at least about 90° C. to improve the tensile strength; however, this is not required. The artificially aging process temperature is typically less than the solutionizing temperature and the time period of the artificially aging process temperature is typically at least 0.1 hours. Generally, the artificially aging process is less than 50° C.-400° C. (the solutionizing temperature). In one non-limiting aspect of the invention, the magnesium composite can be subjected to aging treatment for about 0.5-50 hours (e.g., 1-16 hours, etc.) at a temperature of 90° C.-300° C. (e.g., 100° C.-200° C.).

In another and/or alternative non-limiting aspect of the invention, there is provided a magnesium composite that is over 50 wt. % magnesium and about 0.05-35 wt. % nickel (and all values or ranges therebetween) is added to the magnesium or magnesium alloy to form intermetallic $Mg_2Ni$ as a galvanically-active in situ precipitate. In one non-limiting arrangement, the magnesium composite includes about 0.05-23.5 wt. % nickel, 0.01-5 wt. % nickel, 3-7 wt. % nickel, 7-10 wt. % nickel, or 10-24.5 wt. % nickel. The nickel is added to the magnesium or magnesium alloy while the temperature of the molten magnesium or magnesium alloy is less than the melting point of the nickel. Throughout the mixing process, the temperature of the molten magnesium or magnesium alloy is less than the melting point of the nickel. During the mixing process, solid particles of $Mg_2Ni$ are formed. Once the mixing process is complete, the mixture of molten magnesium or magnesium alloy; solid particles of $Mg_2Ni$, and any unalloyed nickel particles are cooled and an in situ precipitate of solid particles of $Mg_2Ni$ and any unalloyed nickel particles are formed in the solid magnesium or magnesium alloy. Generally, the temperature of the molten magnesium or magnesium alloy is at least about 200° C. less than the melting point of the nickel added to the molten magnesium or magnesium alloy during the addition and mixing process.

In still another and/or alternative non-limiting aspect of the invention, there is provided a magnesium composite that is over 50 wt. % magnesium and about 0.05-35 wt. % copper (and all values or ranges therebetween) is added to the magnesium or magnesium alloy to form intermetallic $CuMg_2$ as the galvanically-active in situ precipitate. In one non-limiting arrangement, the magnesium composite includes about 0.01-5 wt. % copper, about 0.5-15 wt. % copper, about 15-35 wt. % copper, or about 0.01-20 wt. %. The copper is added to the magnesium or magnesium alloy while the temperature of the molten magnesium or magnesium alloy is less than the melting point of the copper. Throughout the mixing process, the temperature of the molten magnesium or magnesium alloy is less than the melting point of the copper. During the mixing process, solid particles of $CuMg_2$ are formed. Once the mixing process is complete, the mixture of molten magnesium or magnesium alloy, solid particles of $CuMg_2$, and any unalloyed copper particles are cooled and an in situ precipitate of solid particles of $CuMg_2$ and any unalloyed copper particles are formed in the solid magnesium or magnesium alloy. Generally, the temperature of the molten magnesium or magnesium alloy is at least about 200° C. less than the melting point of the copper added to the molten magnesium or magnesium alloy.

In yet another and/or alternative non-limiting aspect of the invention, there is provided a magnesium composite that is over 50 wt. % magnesium and about 0.05-20% by weight cobalt is added to the magnesium or magnesium alloy to form an intermetallic $CoMg_2$ as the galvanically-active in situ precipitate. The cobalt is added to the magnesium or magnesium alloy while the temperature of the molten magnesium or magnesium alloy is less than the melting point of the cobalt. Throughout the mixing process, the temperature of the molten magnesium or magnesium alloy is less than the melting point of the cobalt. During the mixing process, solid particles of $CoMg_2$ are formed. Once the mixing process is complete, the mixture of molten magnesium or magnesium alloy, solid particles of $COMg_2$, and any unalloyed cobalt particles are cooled and an in situ precipitate of solid particles of $CoMg_2$ and any unalloyed cobalt particles are formed in the solid magnesium or magnesium alloy. Generally, the temperature of the molten magnesium or magnesium alloy is at least about 200° C. less than the melting point of the cobalt added to the molten magnesium or magnesium alloy.

In yet another and/or alternative non-limiting aspect of the invention, there is provided a magnesium composite that is over 50 wt. % magnesium and cobalt is added to the magnesium or magnesium alloy which forms an intermetallic $Mg_xCo$ as the galvanically-active particle in situ precipitate. The cobalt is added to the magnesium or magnesium alloy while the temperature of the molten magnesium or magnesium alloy is less than the melting point of the cobalt. Throughout the mixing process, the temperature of the molten magnesium or magnesium alloy is less than the melting point of the cobalt. During the mixing process, solid particles of $CoMg_x$ are formed. Once the mixing process is complete, the mixture of molten magnesium or magnesium alloy, solid particles of $CoMg_x$, and any unalloyed cobalt particles are cooled and an in situ precipitate of solid particles of $CoMg_x$ and any unalloyed cobalt particles are formed in the solid magnesium or magnesium alloy. Generally, the temperature of the molten magnesium or magnesium alloy is at least about 200° C. less than the melting point of the cobalt added to the molten magnesium or magnesium alloy.

In still yet another and/or alternative non-limiting aspect of the invention, there is provided a magnesium composite that is over 50 wt. % magnesium and about 0.5-35% by weight of secondary metal (SM) is added to the magnesium or magnesium alloy to form a galvanically active intermetallic particle when compared to magnesium or a magnesium alloy in the remaining casting where the cooling rate between the liquidus to the solidus is faster than 1° C. per minute. The secondary metal is added to the magnesium or magnesium alloy while the temperature of the molten magnesium or magnesium alloy is less than the melting point of the secondary metal. Throughout the mixing process, the temperature of the molten magnesium or magnesium alloy is less than the melting point of the secondary metal. During the mixing process, solid particles of $SMMg_x$ are formed. Once the mixing process is complete, the mixture of molten magnesium or magnesium alloy, solid particles of $SMMg_x$, and any unalloyed secondary metal particles are cooled and an in situ precipitate of solid particles of $SMMg_x$ and any unalloyed secondary metal particles are formed in the solid magnesium or magnesium alloy. Generally, the temperature of the molten magnesium or magnesium alloy is at least about 200° C. less than the melting point of the secondary metal added to the molten magnesium or magnesium alloy. As can be appreciated, one or more secondary metals can be added to the molten magnesium or magnesium alloy.

In another and/or alternative non-limiting aspect of the invention, there is provided a magnesium composite that is over 50 wt. % magnesium and about 0.5-35% by weight of secondary metal (SM) is added to the magnesium or magnesium alloy to form a galvanically active intermetallic particle when compared to magnesium or a magnesium alloy in the remaining casting where the cooling rate between the liquidus to the solidus is slower than 1° C. per minute. The secondary metal is added to the magnesium or magnesium alloy while the temperature of the molten magnesium or magnesium alloy is less than the melting point of the secondary metal. Throughout the mixing process, the temperature of the molten magnesium or magnesium alloy is less than the melting point of the secondary metal. During the mixing process, solid particles of SMM& are formed. Once the mixing process is complete, the mixture of molten magnesium or magnesium alloy, solid particles of $SMMg_x$, and any unalloyed secondary metal particles are cooled and an in situ precipitate of solid particles of $SMMg_x$ and any unalloyed secondary metal particles are formed in the solid magnesium or magnesium alloy. Generally, the temperature of the molten magnesium or magnesium alloy is at least about 200° C. less than the melting point of the secondary metal added to the molten magnesium or magnesium alloy. As can be appreciated, one or more secondary metals can be added to the molten magnesium or magnesium alloy.

In still another and/or alternative non-limiting aspect of the invention, there is provided a magnesium composite that is over 50 wt. % magnesium and about 0.05-35 wt. % of secondary metal (SM) is added to the magnesium or magnesium alloy to form a galvanically-active intermetallic particle when compared to magnesium or a magnesium alloy in the remaining casting where the cooling rate between the liquidus to the solidus is faster than 0.01° C. per min and slower than 1° C. per minute. The secondary metal is added to the magnesium or magnesium alloy while the temperature of the molten magnesium or magnesium alloy is less than the melting point of the secondary metal. Throughout the mixing process, the temperature of the molten magnesium or magnesium alloy is less than the melting point of the secondary metal. During the mixing process, solid particles of $SMMg_x$ are formed. Once the mixing process is complete, the mixture of molten magnesium or magnesium alloy, solid particles of $SMMg_x$ and any unalloyed secondary metal particles are cooled and an in situ precipitate of solid particles of $SMMg_x$, and any unalloyed secondary metal particles are formed in the solid magnesium or magnesium alloy. Generally, the temperature of the molten magnesium or magnesium alloy is at least about 200° C. less than the melting point of the secondary metal added to the molten magnesium or magnesium alloy. As can be appreciated, one or more secondary metals can be added to the molten magnesium or magnesium alloy.

In yet another and/or alternative non-limiting aspect of the invention, there is provided a magnesium composite that is over 50 wt. % magnesium and about 0.05-35 wt. % of secondary metal (SM) is added to the magnesium or magnesium alloy to form a galvanically-active intermetallic particle when compared to magnesium or a magnesium alloy in the remaining casting where the cooling rate between the liquidus to the solidus is faster than 10° C. per minute. The secondary metal is added to the magnesium or magnesium alloy while the temperature of the molten magnesium or magnesium alloy is less than the melting point of the secondary metal. Throughout the mixing process, the temperature of the molten magnesium or magnesium alloy is less than the melting point of the secondary metal. During the mixing process, solid particles of $SMMg_x$ were formed. Once the mixing process was completed, the mixture of molten magnesium or magnesium alloy, solid particles of $SMMg_x$, and any unalloyed secondary metal particles are cooled and an in situ precipitate of solid particles of $SMMg_x$ and any unalloyed secondary metal particles are formed in the solid magnesium or magnesium alloy. Generally, the temperature of the molten magnesium or magnesium alloy is at least about 200° C. less than the melting point of the secondary metal added to the molten magnesium or magnesium alloy. As can be appreciated, one or more secondary metals can be added to the molten magnesium or magnesium alloy.

In still yet another and/or alternative non-limiting aspect of the invention, there is provided magnesium composite that is over 50 wt. % magnesium and about 0.5-35 wt. % of secondary metal (SM) is added to the magnesium or magnesium alloy to form a galvanically-active intermetallic particle when compared to magnesium or a magnesium alloy in the remaining casting where the cooling rate between the liquidus to the solidus is slower than 10° C. per minute. The secondary metal is added to the magnesium or magnesium alloy while the temperature of the molten magnesium or magnesium alloy is less than the melting point of the secondary metal. Throughout the mixing process, the temperature of the molten magnesium or magnesium alloy is less than the melting point of the secondary metal. During the mixing process, solid particles of SMMgx are formed. Once the mixing process is complete, the mixture of molten magnesium or magnesium alloy, solid particles of SMMgx, and any unalloyed secondary metal particles are cooled and an in situ precipitate of solid particles of SMMgx and any unalloyed secondary metal particles are formed in the solid magnesium or magnesium alloy. Generally, the temperature of the molten magnesium or magnesium alloy is at least about 200° C. less than the melting point of the secondary metal added to the molten magnesium or magnesium alloy. As can be appreciated, one or more secondary metals can be added to the molten magnesium or magnesium alloy.

In another and/or alternative non-limiting aspect of the invention, there is provided a magnesium alloy that includes over 50 wt. % magnesium and includes at least one metal selected from the group consisting of aluminum in an amount of about 0.5-10 wt. %, zinc in amount of about 0.05-6 wt. %, zirconium in an amount of about 0.01-3 wt. %, and/or manganese in an amount of about 0.15-2 wt. %. In one non-limiting formulation, the magnesium alloy that includes over 50 wt. % magnesium and includes at least one metal selected from the group consisting of zinc in amount of about 0.05-6 wt. %, zirconium in an amount of about 0.05-3 wt. %, manganese in an amount of about 0.05-0.25 wt. %, boron in an amount of about 0.0002-0.04 wt. %, and bismuth in an amount of about 0.4-0.7 wt. %. The magnesium alloy can then be heated to a molten state and one or more secondary metal (SM) (e.g., copper, nickel, cobalt, titanium, silicon, iron, etc.) can be added to the molten magnesium alloy which forms an intermetallic galvanically-active particle in situ precipitate. The galvanically-active particle can be $SMMg_x$, $SMAl_x$, $SMZn_x$, $SMZr_x$, $SMMn_x$, $SMB_x$, $SMBi_x$, SM in combination with anyone of B, Bi, Mg, Al, Zn, Zr, and Mn.

In still another and/or alternative non-limiting aspect of the invention, there is provided a magnesium composite that is over 50 wt. % magnesium and at least one metal selected from the group consisting of zinc in an amount of about 0.05-6 wt. %, zirconium in amount of about 0.05-3 wt. %, manganese in an amount of about 0.05-0.25 wt. %, boron in an amount of about 0.0002-0.04 wt. %, and/or bismuth in an amount of about 0.4-0.7 wt. % is added to the magnesium or magnesium alloy to form a galvanically-active intermetallic particle in the magnesium or magnesium alloy. The magnesium alloy can then be heated to a molten state and one or more secondary metal (SM) (e.g., copper, nickel, cobalt, titanium, iron, etc.) can be added to the molten magnesium alloy which forms an intermetallic galvanically-active particle in situ precipitate. The galvanically-active particle can be $SMMg_x$, $SMZn_x$, $SMZr_x$, $SMMn_x$, $SMB_x$, $SMBi_x$, SM in combination with anyone of Mg, Zn, Zr, Mn, B and/or Bi.

In yet another and/or alternative non-limiting aspect of the invention, there is provided a magnesium or magnesium alloy that is over 50 wt. % magnesium and nickel in an amount of about 0.01-5 wt. % is added to the magnesium or magnesium alloy to form a galvanically-active intermetallic particle in the magnesium or magnesium alloy. The nickel is added to the magnesium or magnesium alloy while the temperature of the molten magnesium or magnesium alloy is less than the melting point of the nickel. Throughout the mixing process, the temperature of the molten magnesium or magnesium alloy is less than the melting point of the nickel. During the mixing process, solid particles of $Mg_2Ni$ are formed. Once the mixing process is complete, the mixture of molten magnesium or magnesium alloy, solid particles of $Mg_2Ni$, and any unalloyed nickel particles are cooled and an in situ precipitate of solid particles of $Mg_2Ni$ and any unalloyed nickel particles are formed in the solid magnesium or magnesium alloy. Generally, the temperature of the molten magnesium or magnesium alloy is at least about 200° C. less than the melting point of the nickel added to the molten magnesium or magnesium alloy during the addition and mixing process.

In still yet another and/or alternative non-limiting aspect of the invention, there is provided a magnesium composite that is over 50 wt. % magnesium and nickel in an amount of from about 0.3-7 wt. % is added to the magnesium or magnesium alloy to form a galvanically-active intermetallic particle in the magnesium or magnesium alloy. The nickel is added to the magnesium or magnesium alloy while the temperature of the molten magnesium or magnesium alloy is less than the melting point of the nickel. Throughout the mixing process, the temperature of the molten magnesium or magnesium alloy is less than the melting point of the nickel. During the mixing process, solid particles of $Mg_2Ni$ are formed. Once the mixing process is complete, the mixture of molten magnesium or magnesium alloy, solid particles of $Mg_2Ni$, and any unalloyed nickel particles are cooled and an in situ precipitate of solid particles of $Mg_2Ni$ and any unalloyed nickel particles are formed in the solid magnesium or magnesium alloy. Generally, the temperature of the molten magnesium or magnesium alloy is at least about 200° C. less than the melting point of the nickel added to the molten magnesium or magnesium alloy during the addition and mixing process.

In another and/or alternative non-limiting aspect of the invention, there is provided a magnesium composite that is over 50 wt. % magnesium and nickel in an amount of about 7-10 wt. % is added to the magnesium or magnesium alloy to form a galvanically-active intermetallic particle in the magnesium or magnesium alloy. The nickel is added to the magnesium or magnesium alloy while the temperature of the molten magnesium or magnesium alloy is less than the melting point of the nickel. Throughout the mixing process, the temperature of the molten magnesium or magnesium alloy is less than the melting point of the nickel. During the mixing process, solid particles of $Mg_2Ni$ are formed. Once the mixing process was completed, the mixture of molten magnesium or magnesium alloy, solid particles of $Mg_2Ni$, and any unalloyed nickel particles are cooled and an in situ precipitate of solid particles of $Mg_2Ni$ and any unalloyed nickel particles are formed in the solid magnesium or magnesium alloy. Generally, the temperature of the molten magnesium or magnesium alloy is at least about 200° C. less than the melting point of the nickel added to the molten magnesium or magnesium alloy during the addition and mixing process.

In still another and/or alternative non-limiting aspect of the invention, there is provided a magnesium composite that is over 50 wt. % magnesium and nickel in an amount of about 10-24.5 wt. % is added to the magnesium or magnesium alloy to form a galvanically-active intermetallic particle in the magnesium or magnesium alloy. The nickel is added to the magnesium or magnesium alloy while the temperature of the molten magnesium or magnesium alloy is less than the melting point of the nickel. Throughout the mixing process, the temperature of the molten magnesium or magnesium alloy is less than the melting point of the nickel. During the mixing process, solid particles of $Mg_2Ni$ are formed. Once the mixing process is complete, the mixture of molten magnesium or magnesium alloy, solid particles of $Mg_2Ni$, and any unalloyed nickel particles are cooled and an in situ precipitate of solid particles of $Mg_2Ni$ and any unalloyed nickel particles are formed in the solid magnesium or magnesium alloy. Generally, the temperature of the molten magnesium or magnesium alloy is at least about 200° C. less than the melting point of the nickel added to the molten magnesium or magnesium alloy during the addition and mixing process.

In yet another and/or alternative non-limiting aspect of the invention, there is provided a magnesium composite that is over 50 wt. % magnesium and copper in an amount of about 0.01-5 wt. % is added to the magnesium or magnesium alloy to form a galvanically-active intermetallic particle in the magnesium or magnesium alloy. The copper is added to the magnesium or magnesium alloy while the temperature of the molten magnesium or magnesium alloy is less than the melting point of the copper. Throughout the mixing process, the temperature 50 of the molten magnesium or magnesium alloy is less than the melting point of the copper. During the mixing process, solid particles of $Mg_2Cu$ are formed. Once the mixing process is complete, the mixture of molten magnesium or magnesium alloy, solid particles of $Mg_2Cu$, and any unalloyed nickel particles are cooled and an in situ precipitate of solid particles of $Mg_2Cu$ and any unalloyed copper particles are formed in the solid magnesium or magnesium alloy. Generally, the temperature of the molten magnesium or magnesium alloy is at least about 200° C. less than the melting point of the copper added to the molten magnesium or magnesium alloy during the addition and mixing process.

In still yet another and/or alternative non-limiting aspect of the invention, there is provided a magnesium composite that is over 50 wt. % magnesium and includes copper in an amount of about 0.5-15 wt. % is added to the magnesium or magnesium alloy to form a galvanically-active intermetallic particle in the magnesium or magnesium alloy. The copper is added to the magnesium or magnesium alloy while the temperature of the molten magnesium or magnesium alloy is less than the melting point of the copper. Throughout the mixing process, the temperature of the molten magnesium or magnesium alloy is less than the melting point of the copper. During the mixing process, solid particles of $Mg_2Cu$ are formed. Once the mixing process is complete, the mixture of molten magnesium or magnesium alloy, solid particles of $Mg_2Cu$, and any unalloyed nickel particles are cooled and an in situ precipitate of solid particles of $Mg_2Cu$ and any unalloyed copper particles are formed in the solid magnesium or magnesium alloy. Generally, the temperature of the molten magnesium or magnesium alloy is at least about 200° C. less than the melting point of the copper added to the molten magnesium or magnesium alloy during the addition and mixing process.

In another and/or alternative non-limiting aspect of the invention, there is provided a magnesium composite that is over 50 wt. % magnesium and includes copper in an amount of about 15-35 wt. % is added to the magnesium or magnesium alloy to form a galvanically-active intermetallic particle in the magnesium or magnesium alloy. The copper is added to the magnesium or magnesium alloy while the temperature of the molten magnesium or magnesium alloy is less than the melting point of the copper. Throughout the mixing process, the temperature of the molten magnesium or magnesium alloy is less than the melting point of the copper. During the mixing process, solid particles of $Mg_2Cu$ are formed. Once the mixing process is complete, the mixture of molten magnesium or magnesium alloy, solid particles of $Mg_2Cu$, and any unalloyed nickel particles are cooled and an in situ precipitate of solid particles of $Mg_2Cu$ and any unalloyed copper particles are formed in the solid magnesium or magnesium alloy. Generally, the temperature of the molten magnesium or magnesium alloy is at least about 200°

C. less than the melting point of the copper added to the molten magnesium or magnesium alloy during the addition and mixing process.

In still another and/or alternative non-limiting aspect of the invention, there is provided a magnesium composite that is over 50 wt. % magnesium and includes copper in an amount of about 0.01-20 wt. % is added to the magnesium or magnesium alloy to form a galvanically-active intermetallic particle in the magnesium or magnesium alloy. The copper is added to the magnesium or magnesium alloy while the temperature of the molten magnesium or magnesium alloy is less than the melting point of the copper. Throughout the mixing process, the temperature of the molten magnesium or magnesium alloy is less than the melting point of the copper. During the mixing process, solid particles of $Mg_2Cu$ are formed. Once the mixing process is complete, the mixture of molten magnesium or magnesium alloy, solid particles of $Mg_2Cu$, and any unalloyed nickel particles are cooled and an in situ precipitate of solid particles of $Mg_2Cu$ and any unalloyed copper particles are formed in the solid magnesium or magnesium alloy. Generally, the temperature of the molten magnesium or magnesium alloy is at least about 200° C. less than the melting point of the copper added to the molten magnesium or magnesium alloy during the addition and mixing process.

In yet another and/or alternative non-limiting aspect of the invention, there is provided a magnesium composite that is subjected to heat treatments such as solutionizing, aging and/or cold working to be used to control dissolution rates though precipitation of more or less galvanically-active phases within the alloy microstructure while improving mechanical properties. The aging process (when used) can be for at least about 1 hour, for about 1-50 hours, for about 1-20 hours, or for about 8-20 hours. The solutionizing (when used) can be for at least about 1 hour, for about 1-50 hours, for about 1-20 hours, or for about 8-20 hours.

In still yet another and/or alternative non-limiting aspect of the invention, there is provided a method for controlling the dissolution rate of the magnesium composite wherein the magnesium content is at least about 75% and nickel is added to form in situ precipitation of at least 0.05 wt. % $MgNi_2$ with the magnesium or magnesium alloy and solutionizing the resultant metal at a temperature within a range of 100-500° C. for a period of 0.25-50 hours, the magnesium composite being characterized by higher dissolution rates than metal without nickel additions subjected to the said aging treatment.

In another and/or alternative non-limiting aspect of the invention, there is provided a method for improving the physical properties of the magnesium composite wherein the magnesium content is at least about 85% and nickel is added to form in situ precipitation of at least 0.05 wt. % $MgNi_2$ with the magnesium or magnesium alloy and solutionizing the resultant metal at a temperature at about 100-500° C. for a period of 0.25-50 hours, the magnesium composite being characterized by higher tensile and yield strengths than magnesium base alloys of the same composition, but not including the amount of nickel.

In still another and/or alternative non-limiting aspect of the invention, there is provided a method for controlling the dissolution rate of the magnesium composite wherein the magnesium content in the alloy is at least about 75% and copper is added to form in situ precipitation of at least about 0.05 wt. % $MgCu_2$ with the magnesium or magnesium alloy and solutionizing the resultant metal at a temperature within a range of 100-500° C. for a period of 0.25-50 hours, the magnesium composite being characterized by higher dissolution rates than metal without copper additions subjected to the said aging treatment.

In yet another and/or alternative non-limiting aspect of the invention, there is provided a method for improving the physical properties of the magnesium composite wherein the total content of magnesium in the magnesium or magnesium alloy is at least about 85 wt. % and copper is added to form in situ precipitation of at least 0.05 wt. % $MgCu_2$ with the magnesium or magnesium composite and solutionizing the resultant metal at a temperature of about 100-500° C. for a period of 0.25-50 hours, the magnesium composite is characterized by higher tensile and yield strengths than magnesium base alloys of the same composition, but not including the amount of copper.

In still yet another and/or alternative non-limiting aspect of the invention, there is provided a magnesium composite for use as a dissolvable ball or frac ball in hydraulic fracturing and well drilling.

In another and/or alternative non-limiting aspect of the invention, there is provided a magnesium composite for use as a dissolvable tool for use in well drilling and hydraulic control as well as hydraulic fracturing.

In still another and/or alternative non-limiting aspect of the invention, there is provided a magnesium composite that includes secondary institute formed reinforcements that are not galvanically-active to the magnesium or magnesium alloy matrix to increase the mechanical properties of the magnesium composite. The secondary institute formed reinforcements include a $Mg_2Si$ phase as the in situ formed reinforcement.

In yet another and/or alternative non-limiting aspect of the invention, there is provided a magnesium composite that is subjected to a faster cooling rate from the liquidus to the solidus point to create smaller in situ formed particles.

In still yet another and/or alternative non-limiting aspect of the invention, there is provided a magnesium composite that is subjected to a slower cooling rate from the liquidus to the solidus point to create larger in situ formed particles.

In yet another and/or alternative non-limiting aspect of the invention, there is provided a magnesium composite that is subjected to heat treatments such as solutionizing, aging and/or cold working to be used to control dissolution rates though precipitation of more or less galvanically-active phases within the alloy microstructure while improving mechanical properties. The aging process (when used) can be for at least about 1 hour, for about 1-50 hours, for about 1-20 hours, or for about 8-20 hours. The solutionizing (when used) can be for at least about 1 hour, for about 1-50 hours, for about 1-20 hours, or for about 8-20 hours.

In still yet another and/or alternative non-limiting aspect of the invention, there is provided a method for controlling the dissolution rate of the magnesium composite wherein the magnesium content is at least about 75% and nickel is added to form in situ precipitation of at least 0.05 wt. % $MgNi_2$ with the magnesium or magnesium alloy and solutionizing the resultant metal at a temperature within a range of 100-500° C. for a period of 0.25-50 hours, the magnesium composite being characterized by higher dissolution rates than metal without nickel additions subjected to the said aging treatment.

In another and/or alternative non-limiting aspect of the invention, there is provided a method for improving the physical properties of the magnesium composite wherein the magnesium content is at least about 85% and nickel is added to form in situ precipitation of at least 0.05 wt. % $MgNi_2$ with the magnesium or magnesium alloy and solutionizing the resultant metal at a temperature at about 100-500° C. for a period of 0.25-50 hours, the magnesium composite being characterized by higher tensile and yield strengths than magnesium base alloys of the same composition, but not including the amount of nickel.

In still another and/or alternative non-limiting aspect of the invention, there is provided a method for controlling the dissolution rate of the magnesium composite wherein the magnesium content in the alloy is at least about 75% and copper is added to form in situ precipitation of at least about 0.05 wt. % $MgCu_2$ with the magnesium or magnesium alloy and solutionizing the resultant metal at a temperature within a range of 100-500° C. for a period of 0.25-50 hours, the magnesium composite being characterized by higher dissolution rates than metal without copper additions subjected to the said aging treatment.

In yet another and/or alternative non-limiting aspect of the invention, there is provided a method for improving the physical properties of the magnesium composite wherein the total content of magnesium in the magnesium or magnesium alloy is at least about 85 wt. % and copper is added to form in situ precipitation of at least 0.05 wt. % $MgCu_2$ with the magnesium or magnesium composite and solutionizing the resultant metal at a temperature of about 100-500° C. for a period of 0.25-50 hours, the magnesium composite is characterized by higher tensile and yield strengths than magnesium base alloys of the same composition, but not including the amount of copper.

In still yet another and/or alternative non-limiting aspect of the invention, there is provided a magnesium composite for use as a dissolvable ball or frac ball in hydraulic fracturing and well drilling.

In another and/or alternative non-limiting aspect of the invention, there is provided a magnesium composite for use as a dissolvable tool for use in well drilling and hydraulic control as well as hydraulic fracturing.

In still another and/or alternative non-limiting aspect of the invention, there is provided a magnesium composite that includes secondary institute formed reinforcements that are not galvanically-active to the magnesium or magnesium alloy matrix to increase the mechanical properties of the magnesium composite. The secondary institute formed reinforcements include a $Mg_2Si$ phase as the in situ formed reinforcement.

In yet another and/or alternative non-limiting aspect of the invention, there is provided a magnesium composite that is subjected to a faster cooling rate from the liquidus to the solidus point to create smaller in situ formed particles.

In still yet another and/or alternative non-limiting aspect of the invention, there is provided a magnesium composite that is subjected to a slower cooling rate from the liquidus to the solidus point to create larger in situ formed particles.

In another and/or alternative non-limiting aspect of the invention, there is provided a magnesium composite that is subjected to mechanical agitation during the cooling rate from the liquidus to the solidus point to create smaller in situ formed particles.

In another and/or alternative non-limiting aspect of the invention, there is provided a magnesium composite that is subjected to mechanical agitation during the cooling rate from the liquidus to the solidus point to create smaller in situ formed particles.

In still another and/or alternative non-limiting aspect of the invention, there is provided a magnesium composite that is subjected to chemical agitation during the cooling rate from the liquidus to the solidus point to create smaller in situ formed particles.

In yet another and/or alternative non-limiting aspect of the invention, there is provided a magnesium composite that is subjected to ultrasonic agitation during the cooling rate from the liquidus to the solidus point to create smaller in situ formed particles.

In still yet another and/or alternative non-limiting aspect of the invention, there is provided a magnesium composite that is subjected to deformation or extrusion to further improve dispersion of the in situ formed particles.

In another and/or alternative non-limiting aspect of the invention, there is provided a method for forming a novel magnesium composite including the steps of a) selecting an AZ91D magnesium alloy having 9 wt. % aluminum, 1 wt. % zinc and 90 wt. % magnesium, b) melting the AZ91 D magnesium alloy to a temperature above 800° C., c) adding up to about 7 wt. % nickel to the melted AZ91D magnesium alloy at a temperature that is less than the melting point of nickel, d) mixing the nickel with the melted AZ91D magnesium alloy and dispersing the nickel in the melted alloy using chemical mixing agents while maintaining the temperature below the melting point of nickel, and e) cooling and casting the melted mixture in a steel mold. The cast material has a tensile strength of about 14 ksi, and an elongation of about 3% and a shear strength of 11 ksi. The cast material has a dissolve rate of about 75 $mg/cm^2$-min in a 3% KCl solution at 90° C. The cast material dissolves at a rate of 1 $mg/cm^2$-hr in a 3% KCl solution at 21° C. The cast material dissolves at a rate of 325 $mg/cm^2$-hr. in a 3% KCl solution at 90° C. The cast material can be subjected to extrusion with a 11:1 reduction area. The extruded cast material exhibits a tensile strength of 40 ksi, and an elongation to failure of 12%. The extruded cast material dissolves at a rate of 0.8 $mg/cm^2$-min in a 3% KCl solution at 20° C. The extruded cast material dissolves at a rate of 100 $mg/cm^2$-hr. in a 3% KCl solution at 90° C. The extruded cast material can be subjected to an artificial T5 age treatment of 16 hours between 100° C.-200° C. The aged extruded cast material exhibits a tensile strength of 48 ksi, an elongation to failure of 5%, and a shear strength of 25 ksi. The aged extruded cast material dissolves at a rate of 110 $mg/cm^2$-hr in 3% KCl solution at 90° C. and 1 $mg/cm^2$-hr in 3% KCl solution at 20° C. The cast material can be subjected to a solutionizing treatment T4 for about 18 hours between 400° C.-500° C. and then subjected to an artificial T6 age treatment for about 16 hours between 100° C.-200° C. The aged and solutionized cast material exhibits a tensile strength of about 34 ksi, an elongation to failure of about 11%, and a shear strength of about 18 ksi. The aged and solutionized cast material dissolves at a rate of about 84 $mg/cm^2$-hr in 3% KCl solution at 90° C., and about 0.8 $mg/cm^2$-hr in 3% KCl solution at 20° C.

In another and/or alternative non-limiting aspect of the invention, there is provided a method for forming a novel magnesium composite including the steps of a) selecting an AZ91D magnesium alloy having 9 wt. % aluminum, 1 wt. % zinc and 90 wt. % magnesium, b) melting the AZ91D magnesium alloy to a temperature above 800° C., c) adding up to about 1 wt. % nickel to the melted AZ91D magnesium alloy at a temperature that is less than the melting point of nickel, d) mixing the nickel with the melted AZ91D magnesium alloy and dispersing the nickel in the melted alloy using chemical mixing agents while maintaining the temperature below the melting point of nickel, and e) cooling and casting the melted mixture in a steel mold. The cast material has a tensile strength of about 18 ksi, and an elongation of about 5% and a shear strength of 17 ksi. The cast material has a dissolve rate of about 45 mg/cm2-min in a 3% KCl solution at 90° C. The cast material dissolves at a rate of 0.5 mg/cm$^2$-hr. in a 3% KCl solution at 21° C. The cast material dissolves at a rate of 325 mg/cm$^2$-hr. in a 3% KCl solution at 90° C. The cast material was then subjected to extrusion with a 20:1 reduction area. The extruded cast material exhibits a tensile yield strength of 35 ksi, and an elongation to failure of 12%. The extruded cast material dissolves at a rate of 0.8 mg/cm$^2$-min in a 3% KCl solution at 20° C. The extruded cast material dissolves at a rate of 50 mg/cm$^2$-hr in a 3% KCl solution at 90° C. The extruded cast material can be subjected to an artificial T5 age treatment of 16 hours between 100° C.-200° C. The aged extruded cast material exhibits a tensile strength of 48 ksi, an elongation to failure of 5%, and a shear strength of 25 ksi.

In still another and/or alternative non-limiting aspect of the invention, there is provided a method for forming a novel magnesium composite including the steps of a) selecting an AZ9ID magnesium alloy having about 9 wt. % aluminum, 1 wt. % zinc and 90 wt. % magnesium, b) melting the AZ9ID magnesium alloy to a temperature above 800° C., c) adding about 10 wt. % copper to the melted AZ9ID magnesium alloy at a temperature that is less than the melting point of copper, d) dispersing the copper in the melted AZ9ID magnesium alloy using chemical mixing agents at a temperature that is less than the melting point of copper, and e) cooling casting the melted mixture in a steel mold. The cast material exhibits a tensile strength of about 14 ksi, an elongation of about 3%, and shear strength of 11 ksi. The cast material dissolves at a rate of about 50 mg/cm$^2$-hr. in a 3% KCl solution at 90° C. The cast material dissolves at a rate of 0.6 mg/cm$^2$-hr. in a 3% KCl solution at 21° C. The cast material can be subjected to an artificial T5 age treatment for about 16 hours at a temperature of 100-200° C. The aged cast material exhibits a tensile strength of 50 Ksi, an elongation to failure of 5%, and a shear strength of 25 ksi. The aged cast material dissolved at a rate of 40 mg/cm$^2$-hr in 3% KCl solution at 90° C. and 0.5 mg/cm$^2$-hr in 3% KCl solution at 20° C.

These and other objects, features and advantages of the present invention will become apparent in light of the following detailed description of preferred embodiments thereof, as illustrated in the accompanying drawings.

DETAILED DESCRIPTION OF THE INVENTION

Figure 1:
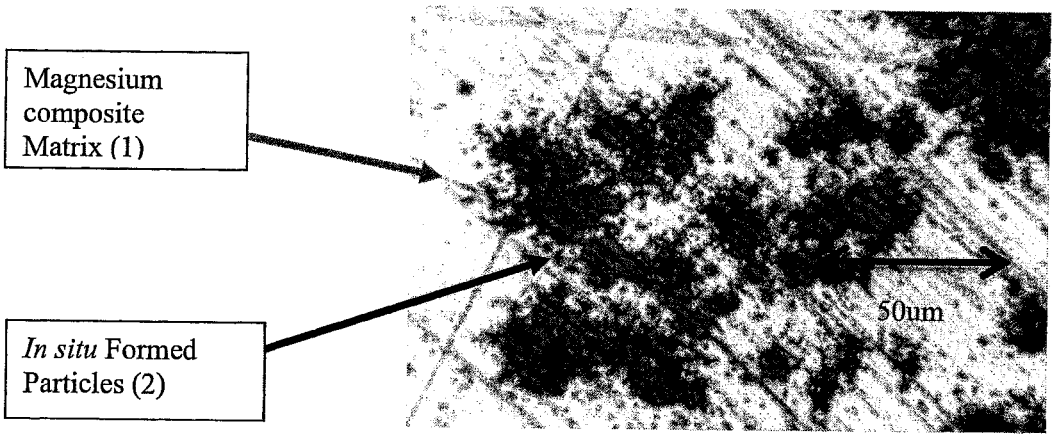
FIGS. 1-3 show a typical cast microstructure with galvanically-active in situ formed intermetallic phase wetted to the magnesium matrix; and, FIG. 4 shows a typical phase diagram to create in situ formed particles of an intermetallic $Mg_x(M)$ where M is any element on the periodic table or any compound in a magnesium matrix and wherein M has a melting point that is greater than the melting point of Mg.
Figure 2:
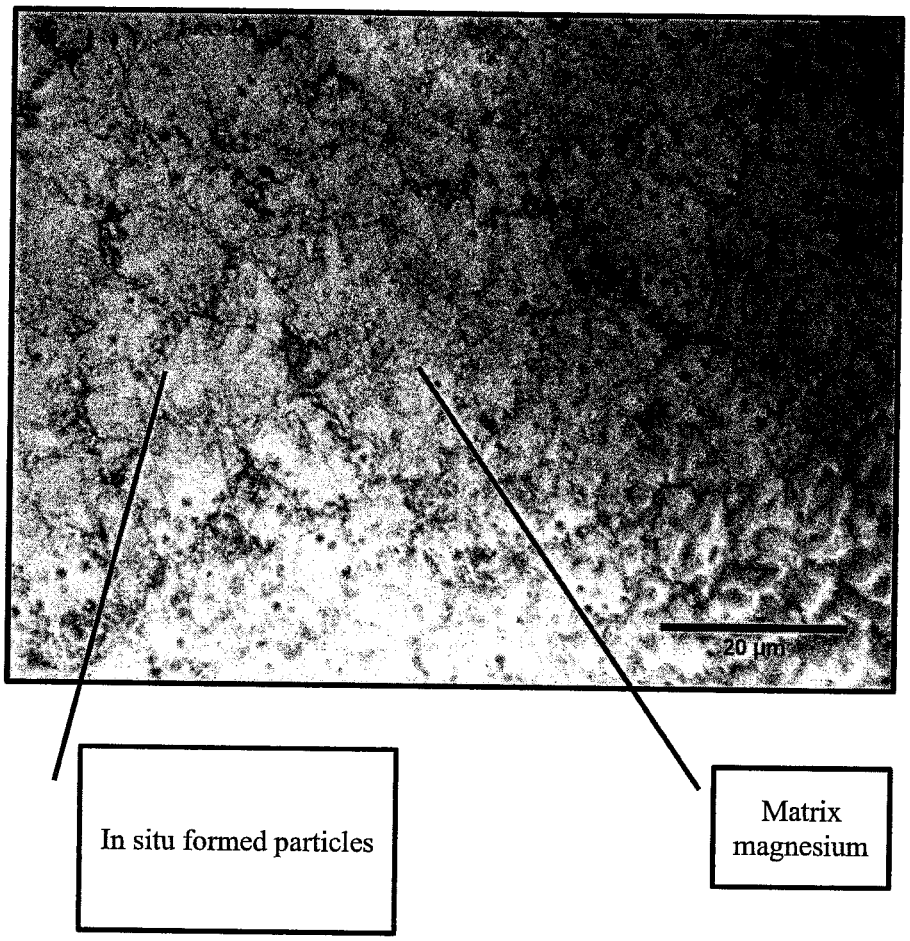
Figure 3:
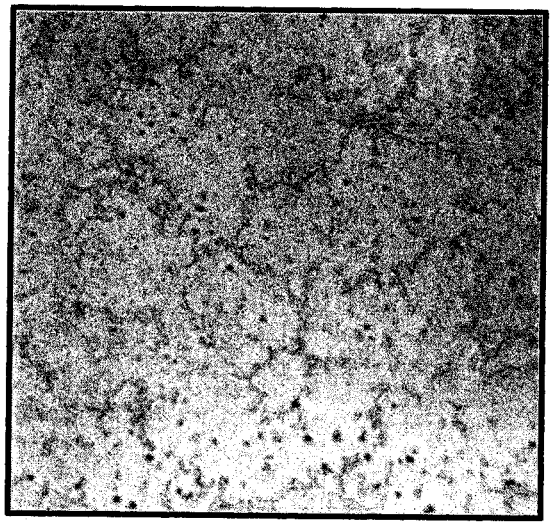
Figure 4:
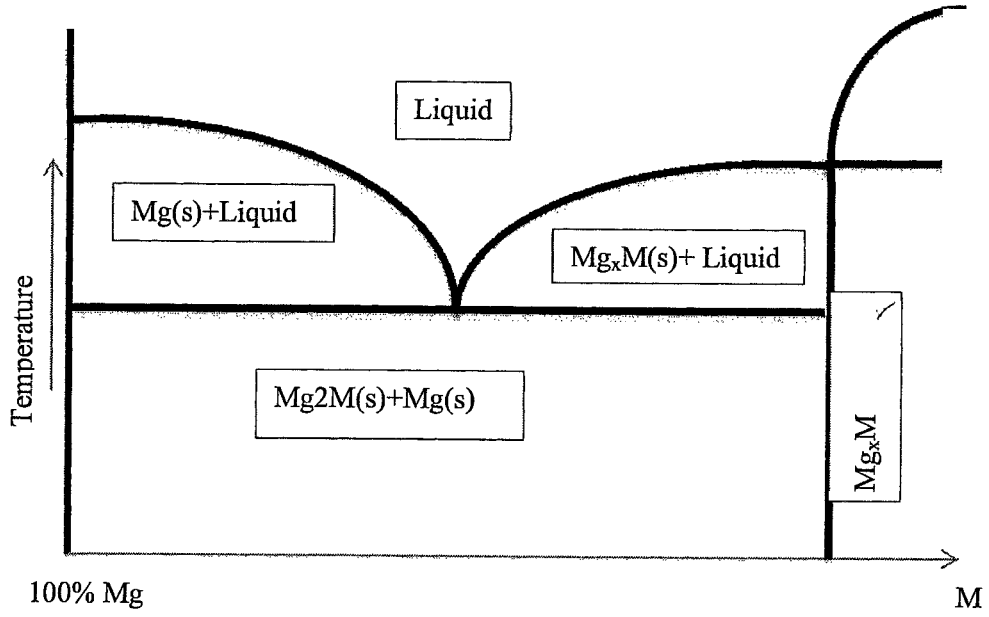

The present invention is directed to a novel magnesium composite that can be used to form a castable, moldable, or extrudable component. The magnesium composite includes at least 50 wt. % magnesium. Generally, the magnesium composite includes over 50 wt. % magnesium and less than about 99.5 wt. % magnesium and all values and ranges therebetween. One or more additives are added to a magnesium or magnesium alloy to form the novel magnesium composite of the present invention. The one or more additives can be selected and used in quantities so that galvanically-active intermetallic or insoluble precipitates form in the magnesium or magnesium alloy while the magnesium or magnesium alloy is in a molten state and/or during the cooling of the melt; however, this is not required. The one or more additives are added to the molten magnesium or magnesium alloy at a temperature that is less than the melting point of the one or more additives. During the process of mixing the one or more additives in the molten magnesium or magnesium alloy, the one or more additives are not caused to fully melt in the molten magnesium or magnesium alloy. After the mixing process is completed, the molten magnesium or magnesium alloy and the one or more additives that are mixed in the molten magnesium or magnesium alloy are cooled to form a solid component. Such a formation in the melt is called in situ particle formation as illustrated in FIGS. 1-3. Such a process can be used to achieve a specific galvanic corrosion rate in the entire magnesium composite and/or along the grain boundaries of the magnesium composite. This feature results in the ability to control where the galvanically-active phases are located in the final casting, as well as the surface area ratio of the in situ phase to the matrix phase, which enables the use of lower cathode phase loadings as compared to a powder metallurgical or alloyed composite to achieve the same dissolution rates. The in situ formed galvanic additives can be used to enhance mechanical properties of the magnesium composite such as ductility, tensile strength, and/or shear strength. The final magnesium composite can also be enhanced by heat treatment as well as deformation processing (such as extrusion, forging, or rolling) to further improve the strength of the final composite over the as-cast material; however, this is not required. The deformation processing can be used to achieve strengthening of the magnesium composite by reducing the grain size of the magnesium composite. Further enhancements, such as traditional alloy heat treatments (such as solutionizing, aging and/or cold working) can be used to enable control of dissolution rates though precipitation of more or less galvanically-active phases within the alloy microstructure while improving mechanical properties; however, this is not required. Because galvanic corrosion is driven by both the electro potential between the anode and cathode phase, as well as the exposed surface area of the two phases, the rate of corrosion can also be controlled through adjustment of the in situ formed particles size, while not increasing or decreasing the volume or weight fraction of the addition, and/or by changing the volume/weight fraction without changing the particle size. Achievement of in situ particle size control can be achieved by mechanical agitation of the melt, ultrasonic processing of the melt, controlling cooling rates, and/or by performing heat treatments. In situ particle size can also or alternatively be modified by secondary processing such as rolling, forging, extrusion and/or other deformation techniques. A smaller particle size can be used to increase the dissolution rate of the magnesium composite. An increase in the weight percent of the in situ formed particles or phases in the magnesium composite can also or alternatively be used to increase the dissolution rate of the magnesium composite. A phase diagram for forming in situ formed particles or phases in the magnesium composite is illustrated in FIG. 4.

In accordance with the present invention, a novel magnesium composite is produced by casting a magnesium metal or magnesium alloy with at least one component to form a galvanically-active phase with another component in the chemistry that forms a discrete phase that is insoluble at the use temperature of the dissolvable component. The in situ formed particles and phases have a different galvanic potential from the remaining magnesium metal or magnesium alloy. The in situ formed particles or phases are uniformly dispersed through the matrix metal or metal alloy using techniques such as thixomolding, stir casting, mechanical agitation, chemical agitation, electrowetting, ultrasonic dispersion, and/or combinations of these methods. Due to the particles being formed in situ to the melt, such particles generally have excellent wetting to the matrix phase and can be found at grain boundaries or as continuous dendritic phases throughout the component depending on alloy composition and the phase diagram. Because the alloys form galvanic intermetallic particles where the intermetallic phase is insoluble to the matrix at use temperatures, once the material is below the solidus temperature, no further dispersing or size control is necessary in the component. This feature also allows for further grain refinement of the final alloy through traditional deformation processing to increase tensile strength, elongation to failure, and other properties in the alloy system that are not achievable without the use of insoluble particle additions. Because the ratio of in situ formed phases in the material is generally constant and the grain boundary to grain surface area is typically consistent even after deformation processing and heat treatment of the composite, the corrosion rate of such composites remains very similar after mechanical processing.

EXAMPLE I

An AZ91D magnesium alloy having 9 wt. % aluminum, 1 wt. % zinc and 90 wt. % magnesium was melted to above 800° C. and at least 200° C. below the melting point of nickel. About 7 wt. % of nickel was added to the melt and dispersed. The melt was cast into a steel mold. The cast material exhibited a tensile strength of about 14 ksi, an elongation of about 3%, and shear strength of 11 ksi. The cast material dissolved at a rate of about 75 mg/cm$^2$-min in a 3% KCl solution at 90° C. The material dissolved at a rate of 1 mg/cm$^2$-hr in a 3% KCl solution at 21° C. The material dissolved at a rate of 325 mg/cm$^2$-hr. in a 3% KCl solution at 90° C.

EXAMPLE 2

The composite in Example 1 was subjected to extrusion with an 11:1 reduction area. The material exhibited a tensile yield strength of 45 ksi, an Ultimate tensile strength of 50 ksi and an elongation to failure of 8%. The material has a dissolve rate of 0.8 mg/cm$^2$-min. in a 3% KCl solution at 20° C. The material dissolved at a rate of 100 mg/cm$^2$-hr. in a 3% KCl solution at 90° C.

EXAMPLE 3

The alloy in Example 2 was subjected to an artificial T5 age treatment of 16 hours from 100° C.-200° C. The alloy exhibited a tensile strength of 48 ksi and elongation to failure of 5% and a shear strength of 25 ksi. The material dissolved at a rate of 110 mg/cm$^2$-hr. in 3% KCl solution at 90° C. and 1 mg/cm$^2$-hr. in 3% KCl solution at 20° C.

EXAMPLE 4

The alloy in Example 1 was subjected to a solutionizing treatment T4 of 18 hours from 400° C.-500° C. and then an artificial T6 aging treatment of 16 hours from 100° C.-200 C. The alloy exhibited a tensile strength of 34 ksi and elongation to failure of 11% and a shear strength of 18 Ksi. The material dissolved at a rate of 84 mg/cm$^2$-hr. in 3% KCl solution at 90° C. and 0.8 mg/cm$^2$-hr. in 3% KCl solution at 20° C.

EXAMPLE 5

An AZ91D magnesium alloy having 9 wt. % aluminum, 1 wt. % zinc and 90 wt. % magnesium was melted to above 800° C. and at least 200° C. below the melting point of copper. About 10 wt. % of copper alloyed to the melt and dispersed. The melt was cast into a steel mold. The cast material exhibited a tensile yield strength of about 14 ksi, an elongation of about 3%, and shear strength of 11 ksi. The cast material dissolved at a rate of about 50 mg/cm$^2$-hr. in a 3% KCl solution at 90° C. The material dissolved at a rate of 0.6 mg/cm$^2$-hr. in a 3% KCl solution at 21° C.

EXAMPLE 6

The alloy in Example 5 was subjected to an artificial T5 aging treatment of 16 hours from 100° C.-200° C. the alloy exhibited a tensile strength of 50 ksi and elongation to failure of 5% and a shear strength of 25 ksi. The material dissolved at a rate of 40 mg/cm$^2$-hr. in 3% KCl solution at 90° C. and 0.5 mg/cm$^2$-hr. in 3% KCl solution at 20° C.

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall there between. The invention has been described with reference to the preferred embodiments. These and other modifications of the preferred embodiments as well as other embodiments of the invention will be obvious from the disclosure herein, whereby the foregoing descriptive matter is to be interpreted merely as illustrative of the invention and not as a limitation. It is intended to include all such modifications and alterations insofar as they come within the scope of the appended claims.

What is claimed:

1. A downhole well component at least partially formed of a dissolvable magnesium cast material, said dissolvable magnesium cast material comprising a mixture of magnesium and additive material or a mixture of magnesium alloy and additive material, said additive material includes i) copper wherein said copper constitutes 0.1-35 wt. % of said dissolvable magnesium cast material, ii) nickel wherein said nickel constitutes 0.1-24.5 wt. % of said dissolvable magnesium cast material, and/or iii) cobalt wherein said cobalt constitutes 0.1-20 wt. % of said dissolvable magnesium cast material, said dissolvable magnesium cast material includes galvanically-active in situ precipitate, said galvanically-active in situ precipitate includes said additive material, said dissolvable magnesium cast material has a dissolution rate of at least 40 mg/cm$^2$/hr. in 3 wt. % KCl water mixture at 90° C., said downhole well component includes one or more components selected from the group consisting of a sleeve, a ball, a frac ball, a hydraulic actuating tooling, a tube, a valve, a valve component, and a plug.

2. The downhole well component as defined in claim 1, wherein said dissolvable magnesium cast material includes no more than 10 wt. % aluminum.

3. The downhole well component as defined in claim 1, wherein said dissolvable magnesium cast material has a dissolution rate of at least 75 mg/cm$^2$/hr. in 3 wt. % KCl water mixture at 90° C.

4. The downhole well component as defined in claim 1, wherein said dissolvable magnesium cast material includes at least 85 wt. % magnesium.

5. The downhole well component as defined in claim 1, wherein said dissolvable magnesium cast material has a dissolution rate of 40-325 mg/cm$^2$/hr. in 3 wt. % KCl water mixture at 90° C.

6. The downhole well component as defined in claim 2, wherein said dissolvable magnesium cast material has a dissolution rate of 40-325 mg/cm$^2$/hr. in 3 wt. % KCl water mixture at 90° C.

7. The downhole well component as defined in claim 4, wherein said dissolvable magnesium cast material has a dissolution rate of 40-325 mg/cm$^2$/hr. in 3 wt. % KCl water mixture at 90° C.

8. The downhole well component as defined in claim 2, wherein said dissolvable magnesium cast material includes at least 85 wt. % magnesium.

9. The downhole well component as defined in claim 3, wherein said dissolvable magnesium cast material includes at least 85 wt. % magnesium.

10. The downhole well component as defined in claim 5, wherein said dissolvable magnesium cast material includes at least 85 wt. % magnesium.

11. The downhole well component as defined in claim 6, wherein said dissolvable magnesium cast material includes at least 85 wt. % magnesium.

12. The downhole well component as defined in claim 8, wherein said dissolvable magnesium cast material has a dissolution rate of at least 75 mg/cm$^2$/hr. in 3 wt. % KCl water mixture at 90° C.

13. The downhole well component as defined in claim 2, wherein said dissolvable magnesium cast material includes at least 50 wt. % magnesium.

14. The downhole well component as defined in claim 13, wherein said dissolvable magnesium cast material has a dissolution rate of at least 75 mg/cm$^2$/hr. in 3 wt. % KCl water mixture at 90° C.

15. The downhole well component as defined in claim 1, wherein said magnesium alloy includes over 50 wt. % magnesium and one or more metals selected from the group consisting of aluminum, boron, bismuth, zinc, zirconium, and manganese.

16. The downhole well component as defined in claim 13, wherein said magnesium alloy includes over 50 wt. % magnesium and one or more metals selected from the group consisting of aluminum, boron, bismuth, zinc, zirconium, and manganese.

17. The downhole well component as defined in claim 14, wherein said magnesium alloy includes over 50 wt. % magnesium and one or more metals selected from the group consisting of aluminum, boron, bismuth, zinc, zirconium, and manganese.

18. The downhole well component as defined in claim 17, wherein said magnesium alloy includes over 50 wt. % magnesium and one or more metals selected from the group consisting of aluminum in an amount of 0.5-10 wt. %, zinc in an amount of 0.1-6 wt. %, zirconium in an amount of 0.01-3 wt. %, manganese in an amount of 0.15-2 wt. %, boron in an amount of 0.0002-0.04 wt. %, and bismuth in an amount of 0.4-0.7 wt. %.

19. The downhole well component as defined in claim 17, wherein said magnesium alloy includes over 50 wt. % magnesium and one or more metals selected from the group consisting of aluminum in an amount of 0.5-10 wt. %, zinc in an amount of 0.1-3 wt. %, zirconium in an amount of 0.01-1 wt.%, manganese in an amount of 0.15-2 wt.%, boron in an amount of 0.0002-0.04 wt. %, and bismuth in amount of 0.4-0.7 wt. %.

20. The downhole well component as defined in claim 17, wherein said magnesium alloy includes at least 85 wt.% magnesium and one or more metals selected from the group consisting of 0.5-10 wt.% aluminum, 0.05-6 wt. % zinc, 0.01-3 wt. % zirconium, and 0.15-2 wt. % manganese.

21. The downhole well component as defined in claim 4, wherein said magnesium alloy includes at least 85 wt. % magnesium and one or more metals selected from the group consisting of 0.5-10 wt. % aluminum, 0.05-6 wt. % zinc, 0.01-3 wt. % zirconium, and 0.15-2 wt. % manganese.

22. The downhole well component as defined in claim 9, wherein said magnesium alloy includes at least 85 wt. % magnesium and one or more metals selected from the group consisting of 0.5-10 wt. % aluminum, 0.05-6 wt. % zinc, 0.01-3 wt. % zirconium, and 0.15-2 wt. % manganese.

23. The downhole well component as defined in claim 12, wherein said magnesium alloy includes at least 85 wt. % magnesium and one or more metals selected from the group consisting of 0.5-10 wt. % aluminum, 0.05-6 wt. % zinc, 0.01-3 wt. % zirconium, and 0.15-2 wt. % manganese.

24. The downhole well component as defined in claim 17, wherein said magnesium alloy comprises greater than 50 wt. % magnesium and one or more metals selected from the group consisting of 0.5-10 wt. % aluminum, 0.1-2 wt. % zinc, 0.01-1 wt. % zirconium, and 0.15-2 wt. % manganese.

25. The downhole well component as defined in claim 17, wherein said magnesium alloy comprises greater than 50 wt. % magnesium and one or more metals selected from the group consisting of 0.1-3 wt. % zinc, 0.05-1 wt. % zirconium, 0.05-0.25 wt. % manganese, 0.0002-0.04 wt. % boron, and 0.4-0.7 wt. % bismuth.

26. The downhole well component as defined in claim 17, wherein said magnesium alloy comprises 60-95 wt. % magnesium, 0.5-10 wt.% aluminum, 0.05- 6 wt. % zinc, and 0.15-2 wt. % manganese.

27. The downhole well component as defined in claim 17, wherein said magnesium alloy includes 60-95 wt. % magnesium and 0.01-1 wt. % zirconium.

28. The downhole well component as defined in claim 17, wherein said magnesium alloy includes 60-95 wt. % magnesium, 0.05-6 wt. % zinc, and 0.01-1 wt. % zirconium.

29. The downhole well component as defined in claim 17, wherein said magnesium alloy includes over 50 wt. % magnesium and one or more metals selected from the group consisting of 0.1-3 wt. % zinc, 0.01-1 wt. % zirconium, 0.05-1 wt. % manganese, 0.0002-0.04 wt. % boron, and 0.4-0.7 wt. % bismuth.

30. The downhole well component as defined in claim 1, wherein said additive material includes nickel, said nickel constitutes 0.3-7 wt. % of said dissolvable magnesium cast material.

31. The downhole well component as defined in claim 1, wherein said additive material includes copper, said copper constitutes 0.5-15 wt. % of said dissolvable magnesium cast material.

32. The downhole well component as defined in claim 4, wherein said additive material includes copper, said copper constitutes 0.5-15 wt. % of said dissolvable magnesium cast material.

33. The downhole well component as defined in claim 9, wherein said additive material includes copper, said copper constitutes 0.5-15 wt. % of said dissolvable magnesium cast material.

34. The downhole well component as defined in claim 12, wherein said additive material includes copper, said copper constitutes 0.5-15 wt. % of said dissolvable magnesium cast material.

35. The downhole well component as defined in claim 11, wherein said additive material includes copper, said copper constitutes 0.5-15 wt. % of said dissolvable magnesium cast material.

36. The downhole well component as defined in claim 14, wherein said additive material includes copper, said copper constitutes 0.5-15 wt. % of said dissolvable magnesium cast material.

37. The downhole well component as defined in claim 1, wherein said downhole well component includes one or more components selected from the group consisting of a ball, tube, or plug.

38. The downhole well component as defined in claim 13, wherein said downhole well component includes one or more components selected from the group consisting of a sleeve, a ball, a frac ball, a hydraulic actuating tooling, a tube, a valve, a valve component, and a plug.

39. The downhole well component as defined in claim 14, wherein said downhole well component includes one or more components selected from the group consisting of a sleeve, a ball, a frac ball, a hydraulic actuating tooling, a tube, a valve, a valve component, and a plug.

40. The downhole well component as defined in claim 1, wherein said dissolvable magnesium cast material has one or more properties selected from the group consisting of a) a tensile strength of 14-50 ksi, b) a shear strength of 11-25 ksi, and c) an elongation of 3-12%.

41. The downhole well component as defined in claim 4, wherein said dissolvable magnesium cast material has one or more properties selected from the group consisting of a) a tensile strength of 14-50 ksi, b) a shear strength of 11-25 ksi, and c) an elongation of 3-12%.

42. The downhole well component as defined in claim 9, wherein said dissolvable magnesium cast material has one or more properties selected from the group consisting of a) a tensile strength of 14-50 ksi, b) a shear strength of 11-25 ksi, and c) an elongation of 3-12%.

43. The downhole well component as defined in claim 12, wherein said dissolvable magnesium cast material has one or more properties selected from the group consisting of a) a tensile strength of 14-50 ksi, b) a shear strength of 11-25 ksi, and c) an elongation of 3-12%.

44. The downhole well component as defined in claim 13, wherein said dissolvable magnesium cast material has one or more properties selected from the group consisting of a) a tensile strength of 14-50 ksi, b) a shear strength of 11-25 ksi, and c) an elongation of 3-12%.

45. The downhole well component as defined in claim 14, wherein said dissolvable magnesium cast material has one or more properties selected from the group consisting of a) a tensile strength of 14-50 ksi, b) a shear strength of 11-25 ksi, and c) an elongation of 3-12%.

46. A downhole well component at least partially formed of a dissolvable magnesium cast material, said dissolvable magnesium cast material comprising a mixture of magnesium and additive material or a mixture of magnesium alloy and additive material, said dissolvable magnesium cast material includes at least 50 wt. % magnesium, said additive material added to said magnesium or magnesium alloy during formation of said dissolvable magnesium cast material, said additive material includes i) copper wherein said copper constitutes 0.5-15 wt. % of said dissolvable magnesium cast material and/or ii) nickel wherein said nickel constitutes 0.1-23.5 wt. % of said dissolvable magnesium cast material, said dissolvable magnesium cast material includes in situ precipitate, said in situ precipitate includes said additive material, said dissolvable magnesium cast material has a dissolution rate of at least 40 mg/cm$^2$/hr. in 3 wt. % KCl water mixture at 90° C., said downhole well component including one or more components selected from the group consisting of a sleeve, a ball, a frac ball, a hydraulic actuating tooling, a tube, a valve, a valve component, and a plug.

47. The downhole well component as defined in claim 46, wherein said dissolvable magnesium cast material includes no more than 10 wt. % aluminum.

48. The downhole well component as defined in claim 46, wherein said dissolvable magnesium cast material has a dissolution rate of at least 75 mg/cm$^2$/hr. in 3 wt. % KCl water mixture at 90° C.

49. The downhole well component as defined in claim 47, wherein said dissolvable magnesium cast material has a dissolution rate of at least 75 mg/cm$^2$/hr. in 3 wt. % KCl water mixture at 90° C.

50. The downhole well component as defined in claim 46, wherein said dissolvable magnesium cast material includes at least 85 wt. % magnesium.

51. The downhole well component as defined in claim 48, wherein said dissolvable magnesium cast material includes at least 85 wt. % magnesium.

52. The downhole well component as defined in claim 49, wherein said dissolvable magnesium cast material includes at least 85 wt. % magnesium.

53. The downhole well component as defined in claim 49, wherein said magnesium alloy includes at least 85 wt. % magnesium and one or more metals selected from the group consisting of 0.5-10 wt. % aluminum, 0.05-6 wt. % zinc, 0.01-3 wt. % zirconium, and 0.15-2 wt. % manganese.

54. The downhole well component as defined in claim 52, wherein said magnesium alloy includes at least 85 wt. % magnesium and one or more metals selected from the group consisting of 0.5-10 wt. % aluminum, 0.05-6 wt. % zinc, 0.01-3 wt. % zirconium, and 0.15-2 wt. % manganese.

55. The downhole well component as defined in claim 46, wherein said magnesium alloy includes over 50 wt. % magnesium and one or more metals selected from the group consisting of aluminum, boron, bismuth, zinc, zirconium, and manganese.

56. The downhole well component as defined in claim 49, wherein said magnesium alloy includes over 50 wt. % magnesium and one or more metals selected from the group consisting of aluminum, boron, bismuth, zinc, zirconium, and manganese.

57. The downhole well component as defined in claim 55, wherein said magnesium alloy includes over 50 wt. % magnesium and one or more metals selected from the group consisting of aluminum in an amount of 0.5-10 wt. %, zinc in an amount of 0.1-6 wt. %, zirconium in an amount of 0.01-3 wt. %, manganese in an amount of 0.15-2 wt. %, boron in an amount of 0.0002-0.04 wt. %, and bismuth in an amount of 0.4-0.7 wt. %.

58. The downhole well component as defined in claim 56, wherein said magnesium alloy includes over 50 wt. % magnesium and one or more metals selected from the group consisting of aluminum in an amount of 0.5-10 wt. %, zinc in an amount of 0.1-6 wt. %, zirconium in an amount of 0.01-3 wt. %, manganese in an amount of 0.15-2 wt. %, boron in an amount of 0.0002-0.04 wt. %, and bismuth in an amount of 0.4-0.7 wt. %.

59. The downhole well component as defined in claim 55, wherein said magnesium alloy comprises greater than 50 wt. % magnesium and one or more metals selected from the group consisting of 0.5-10 wt. % aluminum, 0.1-2 wt. % zinc, 0.01-1 wt. % zirconium, and 0.15-2 wt. % manganese.

60. The downhole well component as defined in claim 56, wherein said magnesium alloy comprises greater than 50 wt. % magnesium and one or more metals selected from the group consisting of 0.5-10 wt. % aluminum, 0.1-2 wt. % zinc, 0.01-1 wt. % zirconium, and 0.15-2 wt. % manganese.

61. The downhole well component as defined in claim 55, wherein said magnesium alloy comprises greater than 50 wt. % magnesium and one or more metals selected from the group consisting of 0.1-3 wt. % zinc, 0.05-1 wt. % zirconium, 0.05-0.25 wt. % manganese, 0.0002-0.04 wt. % boron, and 0.4-0.7 wt. % bismuth.

62. The downhole well component as defined in claim 56, wherein said magnesium alloy comprises greater than 50 wt. % magnesium and one or more metals selected from the group consisting of 0.1-3 wt. % zinc, 0.05-1 wt. % zirconium, 0.05-0.25 wt. % manganese, 0.0002-0.04 wt. % boron, and 0.4-0.7 wt. % bismuth.

63. The downhole well component as defined in claim 55, wherein said magnesium alloy comprises 60-95 wt. % magnesium, 0.5-10 wt. % aluminum, 0.05-6 wt. % zinc, and 0.15-2 wt. % manganese.

64. The downhole well component as defined in claim 56, wherein said magnesium alloy comprises 60-95 wt. % magnesium, 0.5-10 wt. % aluminum, 0.05-6 wt. % zinc, and 0.15-2 wt. % manganese.

65. The downhole well component as defined in claim 55, wherein said magnesium alloy includes 60-95 wt. % magnesium and 0.01-1 wt. % zirconium.

66. The downhole well component as defined in claim 56, wherein said magnesium alloy includes 60-95 wt. % magnesium and 0.01-1 wt. % zirconium.

67. The downhole well component as defined in claim 55, wherein said magnesium alloy includes 60-95 wt. % magnesium, 0.05-6 wt. % zinc, and 0.01-1 wt. % zirconium.

68. The downhole well component as defined in claim 56, wherein said magnesium alloy includes 60-95 wt. % magnesium, 0.05-6 wt. % zinc, and 0.01-1 wt. % zirconium.

69. The downhole well component as defined in claim 55, wherein said magnesium alloy includes over 50 wt. % magnesium and one or more metals selected from the group consisting of 0.1-3 wt. % zinc, 0.01-1 wt. % zirconium, 0.05-1 wt. % manganese, 0.0002-0.04 wt. % boron, and 0.4-0.7 wt. % bismuth.

70. The downhole well component as defined in claim 56, wherein said magnesium alloy includes over 50 wt. % magnesium and one or more metals selected from the group consisting of 0.1-3 wt. % zinc, 0.01-1 wt. % zirconium, 0.05-1 wt. % manganese, 0.0002-0.04 wt. % boron, and 0.4-0.7 wt. % bismuth.

71. The downhole well component as defined in claim 46, wherein said dissolvable magnesium cast material has a tensile strength of 14-50 ksi, a shear strength of 11- 25 ksi, and an elongation of 3-12%.

72. The downhole well component as defined in claim 69, wherein said dissolvable magnesium cast material has a tensile strength of 14-50 ksi, a shear strength of 11-25 ksi, and an elongation of 3-12%.

73. The downhole well component as defined in claim 70, wherein said dissolvable magnesium cast material has a tensile strength of 14-50 ksi, a shear strength of 11-25 ksi, and an elongation of 3-12%.

74. A downhole well component at least partially formed of a dissolvable magnesium cast material, said dissolvable magnesium cast material comprising a mixture of magnesium and additive material or a mixture of magnesium alloy and additive material, said dissolvable magnesium cast material including includes at least 50 wt. % magnesium, said additive material is added to said magnesium or magnesium alloy during formation of said dissolvable magnesium cast material, said additive material includes nickel wherein said nickel constitutes 0.1-23.5 wt. % of said dissolvable magnesium cast material, said dissolvable magnesium cast material includes in situ precipitate, said in situ precipitate includes said additive material, said dissolvable magnesium cast material has a dissolution rate of at least 40 $mg/cm^2/hr.$ in 3 wt. % KCl water mixture at 90° C.

75. The downhole well component as defined in claim 74, wherein said dissolvable magnesium cast material includes no more than 10 wt. % aluminum.

76. The downhole well component as defined in claim 74, wherein said dissolvable magnesium cast material has a dissolution rate of at least 75 $mg/cm^2/hr.$ in 3 wt. % KCl water mixture at 90° C.

77. The downhole well component as defined in claim 75, wherein said dissolvable magnesium cast material has a dissolution rate of at least 75 $mg/cm^2/hr.$ in 3 wt. % KCl water mixture at 90° C.

78. The downhole well component as defined in claim 74, wherein said dissolvable magnesium cast material includes at least 85 wt. % magnesium.

79. The downhole well component as defined in claim 75, wherein said dissolvable magnesium cast material includes at least 85 wt. % magnesium.

80. The downhole well component as defined in claim 76, wherein said dissolvable magnesium cast material includes at least 85 wt. % magnesium.

81. The downhole well component as defined in claim 77, wherein said dissolvable magnesium alloy includes at least 85 wt. % magnesium.

82. The downhole well component as defined in claim 74, wherein said downhole well component including includes one or more components selected from the group consisting of a sleeve, a ball, a frac ball, a hydraulic actuating tooling, a tube, a valve, a valve component, and a plug.

83. The downhole well component as defined in claim 77, wherein said downhole well component including includes one or more components selected from the group consisting of a sleeve, a ball, a frac ball, a hydraulic actuating tooling, a tube, a valve, a valve component, and a plug.

84. The downhole well component as defined in claim 81, wherein said downhole well component including includes one or more components selected from the group consisting of a sleeve, a ball, a frac ball, a hydraulic actuating tooling, a tube, a valve, a valve component, and a plug.

85. The downhole well component as defined in claim 74, wherein said dissolvable magnesium cast material has a tensile strength of 14-50 ksi, a shear strength of 11-25 ksi, and an elongation of 3-12%.

86. The downhole well component as defined in claim 82, wherein said dissolvable magnesium cast material has a tensile strength of 14-50 ksi, a shear strength of 11-25 ksi, and an elongation of 3-12%.

87. The downhole well component as defined in claim 83, wherein said dissolvable magnesium cast material has a tensile strength of 14-50 ksi, a shear strength of 11-25 ksi, and an elongation of 3-12%.

88. The downhole well component as defined in claim 83, wherein said dissolvable magnesium cast material has a tensile strength of 14-50 ksi, a shear strength of 11-25 ksi, and an elongation of 3-12%.

89. A downhole well component at least partially formed of a dissolvable magnesium cast material, said dissolvable magnesium cast material comprising a mixture of magnesium alloy and additive material, said magnesium alloy includes at least 85 wt. % magnesium and one or more metals selected from the group consisting of aluminum, boron, bismuth, zinc, zirconium, and manganese, said additive material added to said magnesium alloy during formation of said dissolvable magnesium cast material, said additive material includes nickel wherein said nickel constitutes at least 0.01 wt. % of said dissolvable magnesium cast material, said dissolvable magnesium cast material includes in situ precipitate, said in situ precipitate includes said additive material, said dissolvable magnesium cast material has a dissolution rate of at least 75 $mg/cm^2/hr$. in 3 wt. % KCl water mixture at 90° C., said downhole well component includes one or more components selected from the group consisting of a sleeve, a ball, a frac ball, a hydraulic actuating tooling, a tube, a valve, a valve component, and a plug.

90. The downhole well component as defined in claim 89, wherein said dissolvable magnesium cast material includes no more than 10 wt. % aluminum.

91. The downhole well component as defined in claim 89, wherein said nickel constitutes 0.01-5 wt. % of said dissolvable magnesium cast material.

92. The downhole well component as defined in claim 90, wherein said nickel constitutes 0.01-5 wt. % of said dissolvable magnesium cast material.

93. The downhole well component as defined in claim 89, wherein said nickel constitutes 0.1-24.5 wt. % of said dissolvable magnesium cast material.

94. The downhole well component as defined in claim 90, wherein said nickel constitutes 0.1-24.5 wt. % of said dissolvable magnesium cast material.

95. The downhole well component as defined in claim 89, wherein said in situ precipitate has a size of less than 50 μm.

96. The downhole well component as defined in claim 90, wherein said in situ precipitate has a size of less than 50 μm.

97. The downhole well component as defined in claim 91, wherein said in situ precipitate has a size of less than 50 μm.

98. The downhole well component as defined in claim 92, wherein said in situ precipitate has a size of less than 50 μm.

99. The downhole well component as defined in claim 93, wherein said in situ precipitate has a size of less than 50 μm.

100. The downhole well component as defined in claim 94, wherein said in situ precipitate has a size of less than 50 μm.

* * * * *